US011905645B2

(12) United States Patent
Lee et al.

(10) Patent No.: US 11,905,645 B2
(45) Date of Patent: Feb. 20, 2024

(54) LAUNDRY TREATING APPARATUS AND METHOD FOR CONTROLLING THE SAME

(71) Applicant: LG Electronics Inc., Seoul (KR)

(72) Inventors: Sunho Lee, Seoul (KR); Youngjong Kim, Seoul (KR); Dongcheol Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 17/392,906

(22) Filed: Aug. 3, 2021

(65) Prior Publication Data

US 2022/0049396 A1 Feb. 17, 2022

(30) Foreign Application Priority Data

Aug. 14, 2020 (KR) ..... 10-2020-0102609

(51) Int. Cl.

| | |
|---|---|
| ***D06F 58/50*** | (2020.01) |
| ***D06F 34/18*** | (2020.01) |
| *D06F 33/36* | (2020.01) |
| *D06F 37/40* | (2006.01) |
| *D06F 33/34* | (2020.01) |
| *D06F 103/24* | (2020.01) |
| *D06F 105/48* | (2020.01) |
| *D06F 103/06* | (2020.01) |

(Continued)

(52) U.S. Cl.

CPC ..... *D06F 58/50* (2020.02); *D06F 34/18* (2020.02); *D06F 33/34* (2020.02); *D06F 33/36* (2020.02); *D06F 37/40* (2013.01); *D06F 2103/04* (2020.02); *D06F 2103/06* (2020.02); *D06F 2103/08* (2020.02); *D06F 2103/24* (2020.02); *D06F 2105/48* (2020.02)

(58) Field of Classification Search

CPC ..... D06F 58/50; D06F 34/18

See application file for complete search history.

(56) References Cited

U.S. PATENT DOCUMENTS 2,111,152 A * 3/1938 Jabez ..... D06F 13/00 68/134

4,693,095 A 9/1987 Burk et al.

(Continued)

FOREIGN PATENT DOCUMENTS

| | | |
|---|---|---|
| EP | 1423563 | 8/2006 |
| JP | 2861281 | 2/1999 |
| JP | 2012152483 | 8/2012 |

OTHER PUBLICATIONS

International Search Report and Written Opinion in International Appln. No. PCT/KR2021/009702, dated Nov. 15, 2021, 10 pages.

*Primary Examiner* — Michael E Barr
*Assistant Examiner* — Kevin G Lee
(74) *Attorney, Agent, or Firm* — Fish & Richardson P.C.

(57) ABSTRACT

A method for controlling a laundry treating apparatus includes a dry cloth sensing operation of sensing an amount of clothes put into a drum, a wet cloth sensing operation of sensing a washing load based on a moisture content of the clothes by supplying water into a tub, and a cloth material sensing operation of sensing a cloth material of the clothes put into the drum based on a rpm gap and a motor-constrained state where rotation of a motor is restricted. The rpm gap is a difference between a target rpm of a rotator in the drum and an actual rpm of the rotator.

20 Claims, 16 Drawing Sheets

(51) Int. Cl.
*D06F 103/08* (2020.01)
*D06F 103/04* (2020.01)

(56) References Cited

U.S. PATENT DOCUMENTS

| | | | | |
|---|---|---|---|---|
| 6,158,072 | A * | 12/2000 | Baek | D06F 34/18 68/12.04 |
| 2006/0125428 | A1* | 6/2006 | Schulze | D06F 35/007 318/53 |
| 2011/0191964 | A1* | 8/2011 | Ashrafzadeh | D06F 23/00 68/12.02 |
| 2013/0125315 | A1 | 5/2013 | Nieh et al. | |

* cited by examiner

LAUNDRY TREATING APPARATUS AND METHOD FOR CONTROLLING THE SAME

CROSS-REFERENCE TO RELATED APPLICATIONS

This application claims the benefit of Korean Patent Application No. 10-2020-0102609, filed on Aug. 14, 2020, which is hereby incorporated by reference as if fully set forth herein.

TECHNICAL FIELD

The present disclosure relates to a laundry treating apparatus, and more particularly, to a laundry treating apparatus having a rotator disposed in a drum.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a housing forming an appearance of the laundry treating apparatus, a tub accommodated in the housing, a drum that is rotatably mounted inside the tub and into which the laundry is put, and a detergent feeder that feeds detergent into the drum.

When the drum is rotated by a motor while wash water is supplied to the laundry accommodated in the drum, dirt on the laundry may be removed by friction with the drum and the wash water.

In one example, a rotator may be disposed inside the drum to improve a laundry washing effect. The rotator may be rotated inside the drum to form a water flow, and the laundry washing effect may be improved by the rotator.

Korean Patent No. 10-0186729 discloses a laundry treating apparatus including a rotator disposed inside a drum. The laundry treating apparatus improves a washing efficiency by rotating the rotator to form a water flow.

An efficient design is required for the rotator such that the water flow formed by the rotation may improve the washing efficiency. Furthermore, a design that may effectively reduce a load on a motor by effectively reducing a load on the rotation of the rotator is required.

Therefore, it is an important task in the art to design the rotator such that the rotator may rotate to effectively improve the washing efficiency and the load on the rotation of the rotator may be effectively reduced.

SUMMARY

Embodiments of the present disclosure are intended to provide a laundry treating apparatus including a rotator that forms a water flow that may effectively improve a washing efficiency, and a method for controlling the same.

In addition, embodiments of the present disclosure are intended to provide a laundry treating apparatus that is efficiently designed to effectively improve a space utilization and a washing efficiency, and a method for controlling the same.

In addition, embodiments of the present disclosure are intended to provide a laundry treating apparatus that may perform efficient washing by sensing an amount of cloth put into a drum, a moisture of the cloth, and a material of the cloth, and a method for controlling the same.

In addition, embodiments of the present disclosure are intended to provide a laundry treating apparatus and a method for controlling the same that may minimize a load applied to a rotator by performing washing with a separate process when there are a large number of cloths with a large moisture content depending on a material of the cloth, or under an abnormal load such as a towel or shoes.

In a case of a special washing load such as a towel or shoes, a situation in which rotation of a rotator is restricted may occur. As an example for solving the above problems, a laundry treating apparatus and a method for controlling the same capable of solving this are provided.

Specifically, a laundry treating apparatus and a method for controlling the same capable of sensing a cloth material through determination on whether rotation of a motor is restricted and rpm following determination to determine the special washing load or an abnormal load are provided.

According to an aspect of the present disclosure, provided is a method for controlling a laundry treating apparatus including a cabinet, a tub for providing therein a space for water to be stored, a drum rotatably disposed inside the tub, wherein the drum includes an open surface for inserting and withdrawing clothes therethrough and a bottom surface located on an opposite side of the open surface, a rotator rotatably installed on the bottom surface and inside the drum, a driver including a motor for driving the drum and the rotator, and a controller that controls an operation of the driver, wherein the rotator includes a bottom portion positioned on the bottom surface, a pillar protruding from the bottom portion toward the open surface, and a plurality of blades disposed to be spaced apart from each other along a circumferential direction of the pillar, wherein the blade extends from the bottom surface to the open surface along a direction inclined with respect to a longitudinal direction of the pillar, the method including a dry cloth sensing operation of sensing an amount of cloth put into the drum, a wet cloth sensing operation of sensing a washing load based on a moisture content of the cloth by injecting water into the tub, and a cloth material sensing operation of sensing a cloth material of the clothes put into the drum based on a rpm gap and a motor-constrained state where rotation of the motor is restricted, wherein the rpm gap is a difference between a target rpm of the rotator and a following rpm at which the rotator is actually rotated.

In one implementation, the cloth material sensing operation may include a first motor constraint determination operation of determining whether the motor is in the motor-constrained state where the rotation of the motor is restricted after the wet cloth sensing operation is performed.

In one implementation, the cloth material sensing operation may include a first rpm following determination operation of determining the rpm gap when it is determined in the first motor constraint determination operation that the rotation of the motor is not restricted.

In one implementation, the first rpm following determination operation may include a cycle where the target rpm is set and the rotator is agitated a preset number of times to measure the following rpm.

In one implementation, the cycle may be performed multiple times.

In one implementation, when the rpm gap is equal to or less than a preset reference in the first rpm following determination operation, a first washing process, a washing course corresponding to a washing load, may be performed.

In one implementation, when it is determined in the first rpm following determination operation that the rpm gap is equal to or greater than a preset reference or when it is determined in the first motor constraint determination operation that the motor is in the motor-constrained state where the rotation of the motor is restricted, an additional water supply operation of supplying water into the tub may be performed.

In one implementation, a second motor constraint determination operation of determining whether the motor is in the motor-constrained state where the rotation of the motor is restricted may be performed after the additional water supply operation is performed.

In one implementation, the method may further include a second rpm following determination operation of determining the rpm gap when it is determined in the second motor constraint determination operation that the rotation of the motor is not restricted.

In one implementation, the second rpm following determination operation may include a cycle where the target rpm is set and the rotator is agitated a preset number of times to measure the following rpm.

In one implementation, when the rpm gap is equal to or less than the preset reference in the second rpm following determination operation, a second washing process, a washing course corresponding to a water level after the additional water supply operation, may be performed.

In one implementation, an rpm of the rotator may be higher in the second washing process than in a first washing process, a washing course corresponding to a washing load.

In one implementation, when it is determined in the second motor constraint determination operation that the motor is in the motor-constrained state where the rotation of the motor is restricted or when it is determined in the second rpm following determination operation that the rpm gap is equal to or greater than the preset reference, a third washing process, a washing course separate from a first washing process and a second washing process may be performed, wherein the first washing process is a washing course corresponding to a washing load, and the second washing process is a washing course corresponding to a water level after the additional water supply operation.

In one implementation, an rpm of the rotator may be controlled to be lower in the third washing process than in the first washing process and the second washing process.

In one implementation, the rotator may be rotated at a rotation angle equal to or lower than 90 degrees in the third washing process.

In one implementation, when water is able to be supplied into the tub before the third washing process is performed, the third washing process may be performed after performing the additional water supply into the tub.

According to another aspect of the present disclosure, provided is a laundry treating apparatus including a cabinet, a tub for providing therein a space for water to be stored, a drum rotatably disposed inside the tub, wherein the drum includes an open surface for inserting and withdrawing clothes therethrough and a bottom surface located on an opposite side of the open surface, a rotator rotatably installed on the bottom surface and inside the drum, a driver including a motor for driving the drum and the rotator, and a controller that controls an operation of the driver, wherein the rotator includes a bottom portion positioned on the bottom surface, a pillar protruding from the bottom portion toward the open surface, and a plurality of blades disposed to be spaced apart from each other along a circumferential direction of the pillar, wherein the blade extends from the bottom surface to the open surface along a direction inclined with respect to a longitudinal direction of the pillar, wherein the controller senses a cloth material of the clothes put into the drum based on a rpm gap and a motor-constrained state where rotation of the motor is restricted, wherein the rpm gap is a difference between a target rpm of the rotator and a following rpm at which the rotator is actually rotated.

In one implementation, when the rotation of the motor is restricted or when the rpm gap is equal to or greater than a preset reference, wherein, after additional water supply into the tub is performed, the controller may sense the cloth material of the clothes put into the drum again based on the rpm gap and whether the motor is in the motor-constrained state where the rotation of the motor is restricted, wherein the rpm gap is the difference between the target rpm of the rotator and the following rpm at which the rotator is actually rotated.

According to the laundry treating apparatus and the method for controlling the same according to the embodiments of the present disclosure, the rotator is disposed, so that the effective washing is possible.

In addition, the effective washing is possible by changing the washing course by identifying the quantity and the quality of the cloths put in the drum.

DETAILED DESCRIPTION

Hereinafter, a specific embodiment of the present disclosure will be described with reference to the drawings. A following detailed description is provided to provide a comprehensive understanding of a method, an apparatus, and/or a system described herein. However, this is merely an example and the present disclosure is not limited thereto.

In describing embodiments of the present disclosure, when it is determined that a detailed description of the prior art related to the present disclosure may unnecessarily obscure the gist of the present disclosure, the detailed description thereof will be omitted. In addition, terms to be described later are terms defined in consideration of functions in the present disclosure, which may vary based on intentions of users and operators, customs, or the like. Therefore, a definition thereof should be made based on a content throughout this specification. The terminology used in the detailed description is for the purpose of describing embodiments of the present disclosure only, and should not be limiting. As used herein, the singular forms 'a' and 'an' are intended to include the plural forms as well, unless the context clearly indicates otherwise. It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in describing the components of the embodiment of the present disclosure, terms such as first, second, A, B, (a), (b) may be used. Such terms are only for distinguishing the component from other components, and the essence, order, or order of the component is not limited by the term.

Figure 1:
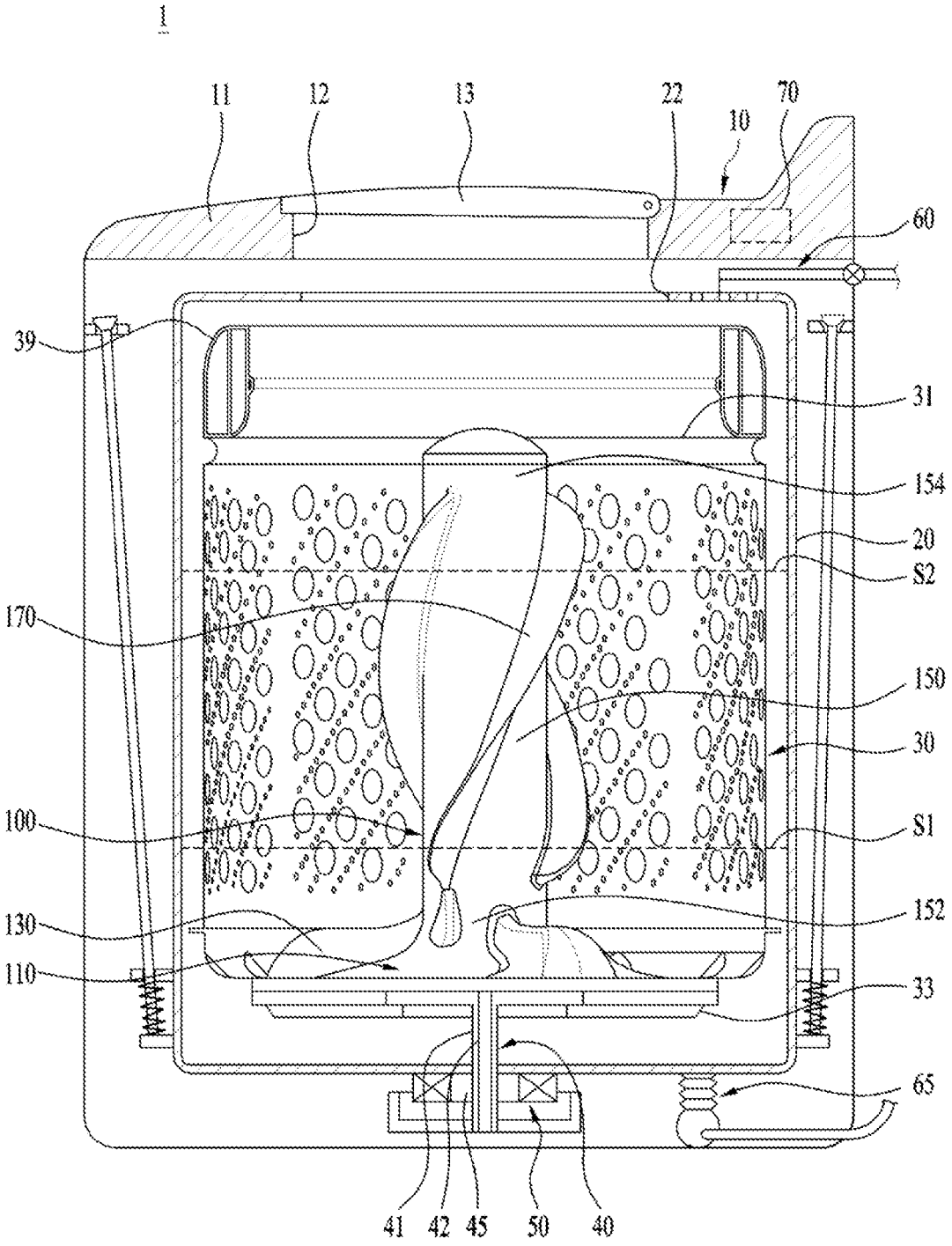
FIG. 1 is a view showing an interior of a laundry treating apparatus according to an embodiment of the present disclosure.

FIG. 1 shows an interior of a laundry treating apparatus 1 according to an embodiment of the present disclosure. The laundry treating apparatus 1 may include a cabinet 10, a tub 20, and a drum 30.

The cabinet 10 may be in any shape as long as being able to accommodate the tub 20, and FIG. 1 shows a case in which the cabinet 10 forms an appearance of the laundry treating apparatus 1 as an example.

The cabinet 10 may have a laundry inlet 12 defined therein for putting laundry into the drum 30 or withdrawing the laundry stored in the drum 30 to the outside, and may have a laundry door 13 for opening and closing the laundry inlet 12.

FIG. 1 shows that a laundry inlet 12 is defined in a top surface 11 of a cabinet 10 according to an embodiment of the present disclosure, and a laundry door 13 for opening and closing the laundry inlet 12 is disposed on the top surface 11. However, the laundry inlet 12 and the laundry door 13 are not necessarily limited to being defined in and disposed on the top surface 11 of the cabinet 10.

A tub 20 is means for storing water necessary for washing laundry. The tub 20 may have a tub opening 22 defined therein in communication with the laundry inlet 12. For example, one surface of the tub 20 may be opened to define the tub opening 22. At least a portion of the tub opening 22 may be positioned to face the laundry inlet 12, so that the tub opening 22 may be in communication with the laundry inlet 12.

FIG. 1 shows a top loading type laundry treating apparatus 1 according to an embodiment of the present disclosure. Therefore, FIG. 1 shows that a top surface of the tub 20 is opened to define the tub opening 22, and the tub opening 22 is positioned below the laundry inlet 12 and in communication with the laundry inlet 12.

The tub 20 is fixed at a location inside the cabinet 10 through a tub support (not shown). The tub support may be in a structure capable of damping vibrations generated in the tub 20.

The tub 20 is supplied with water through a water supply 60. The water supply 60 may be composed of a water supply pipe that connects a water supply source with the tub 20, and a water supply valve that opens and closes the water supply pipe.

The laundry treating apparatus 1 according to an embodiment of the present disclosure may include a detergent feeder that stores detergent therein and is able to supply the detergent into the tub 20. As the water supply 60 supplies water to the detergent feeder, the water that has passed through the detergent feeder may be supplied to the tub 20 together with the detergent.

In addition, the laundry treating apparatus 1 according to an embodiment of the present disclosure may include a water sprayer that sprays water into the tub 20 through the tub opening 22. The water supply 60 may be connected to the water sprayer to supply water directly into the tub 20 through the water sprayer.

The water stored in the tub 20 is discharged to the outside of the cabinet 10 through a drain 65. The drain 65 may be composed of a drain pipe that guides the water inside the tub 20 to the outside of the cabinet 10, a drain pump disposed on the drain pipe, and a drain valve for controlling opening and closing of the drain pipe.

The drum 30 may be rotatably disposed inside the tub 20. The drum 30 may be constructed to have a circular cross-section in order to be rotatable inside the tub 20. For example, the drum 30 may be in a cylindrical shape as shown in FIG. 1.

The drum 30 may have a drum opening defined therein positioned below the tub opening 22 to communicate with the inlet. One surface of the drum 30 may be opened to define an open surface 31 as will be described later, and the open surface 31 may correspond to the drum opening.

A plurality of drum through-holes that communicate an interior and an exterior of the drum 30 with each other, that is, the interior of the drum 30 and an interior of the tub 20 divided by the drum 30 with each other may be defined in an outer circumferential surface of the drum 30. Accordingly, the water supplied into the tub 20 may be supplied to the interior of the drum 30 in which the laundry is stored through the drum through-holes.

The drum 30 may be rotated by a driver 50. The driver 50 may be composed of a stator fixed at a location outside the tub 20 and forming a rotating magnetic field when a current is supplied, a rotor rotated by the rotating magnetic field, and a rotation shaft 40 disposed to penetrate the tub 20 to connect the drum 30 and the like to the rotor.

As shown in FIG. 1, the rotation shaft 40 may be disposed to form a right angle with respect to a bottom surface of the tub 20. In this case, the laundry inlet 12 may be defined in the top surface 11 of the cabinet 10, the tub opening 22 may be defined in the top surface of the tub 20, and the drum opening may be defined in the top surface of the drum 30.

In one example, when the drum 30 rotates in a state in which the laundry is concentrated in a certain region inside the drum 30, a dynamic unbalance state (an unbalanced state) occurs in the drum 30. When the drum 30 in the unbalanced state rotates, the drum 30 rotates while vibrating by a centrifugal force acting on the laundry. The vibration of the drum 30 may be transmitted to the tub 20 or the cabinet 10 to cause a noise.

To avoid problems like this, the present disclosure may further include a balancer 39 that controls the unbalance of the drum 30 by generating a force to offset or damp the centrifugal force acting on the laundry.

In one example, referring to FIG. 1, the tub 20 may have a space defined therein in which the water may be stored, and the drum 30 may be rotatably disposed inside the tub 20.

The drum 30 may include the open surface 31 through which the laundry enters and exits, and a bottom surface 33 positioned on an opposite side of the open surface 31.

FIG. 1 shows that the top surface of the drum 30 corresponds to the open surface 31, and the bottom surface thereof corresponds to the bottom surface 33 according to an embodiment of the present disclosure. As described above, the open surface 31 may correspond to a surface through which the laundry input through the laundry inlet 12 of the cabinet 10 and the tub opening 22 of the tub 20 passes.

In one example, the water supply 60 may be constructed to be connected to the means such as the detergent feeder, the water sprayer, or the like to supply the water into the tub 20 as described above. In one example, an embodiment of the present disclosure may include a controller 70 that controls the water supply 60 to adjust a water supply amount in a washing process and the like.

The controller 70 is configured to adjust the amount of water supplied to the tub 20 in the washing process, a rinsing process, or the like. The amount of water supplied may be adjusted through a manipulation unit disposed on the cabinet 10 and manipulated by a user, or may be determined through an amount of laundry, a load of the driver 50, or the like.

A plurality of water supply amounts are preset in the controller 70, and the controller 70 may be configured to control the water supply 60 based on one of the preset water supply amounts in response to a command selected by a user or the like in the washing process or the like.

In one example, as shown in FIG. 1, an embodiment of the present disclosure may further include a rotator 100. The rotator 100 may be rotatably installed on the bottom surface 33 and inside the drum 30.

In one embodiment of the present disclosure, the drum 30 and the rotator 100 may be constructed to be rotatable, independently. A water flow may be formed by the rotation of the drum 30 and the rotator 100, and friction or collision with the laundry may occur, so that washing or rinsing of the laundry may be made.

Figure 2:
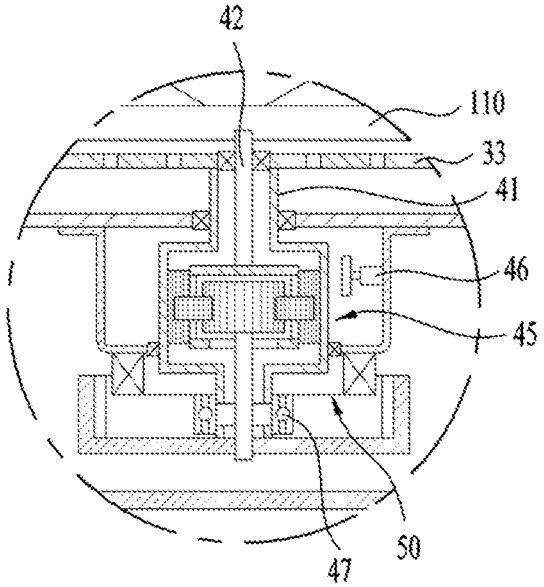
FIG. 2 is a view showing a rotation shaft coupled to a drum and a rotator in a laundry treating apparatus according to an embodiment of the present disclosure.

In one example, FIG. 2 shows the rotation shaft 40 coupled with the drum 30 and the rotator 100 according to an embodiment of the present disclosure.

Each of the drum 30 and the rotator 100 may be connected to the driver 50 through the rotation shaft 40 to receive a rotational force. In one embodiment of the present disclosure, the drum 30 may be rotated as a first rotation shaft 41 is coupled to the bottom surface 33 thereof, and the rotator 100 may be rotated by being coupled to a second rotation shaft 42 that passes through the bottom surface 33 and separately rotated with respect to the first rotation shaft 41.

The second rotation shaft 42 may rotate in a direction the same as or opposite to a rotation direction of the first rotation shaft 41. The first rotation shaft 41 and the second rotation shaft 42 may receive power through one driver 50, and the driver 50 may be connected to a gear set 45 that distributes the power to the first rotation shaft 41 and the second rotation shaft 42 and adjusts the rotation direction.

That is, a driving shaft of the driver 50 may be connected to the gear set 45 to transmit the power to the gear set 45, and each of the first rotation shaft 41 and the second rotation shaft 42 may be connected to the gear set 45 to receive the power.

The first rotation shaft 41 may be constructed as a hollow shaft, and the second rotation shaft 42 may be constructed as a solid shaft disposed inside the first rotation shaft 41. Accordingly, one embodiment of the present disclosure may effectively provide the power to the first rotation shaft 41 and the second rotation shaft 42 parallel to each other through the single driver 50.

FIG. 2 shows a planetary gear-type gear set 45, and shows a state in which each of the driving shaft, the first rotation shaft 41, and the second rotation shaft 42 is coupled to the gear set 45. Referring to FIG. 2, a rotational relationship of the first rotation shaft 41 and the second rotation shaft 42 in one embodiment of the present disclosure will be described as follows.

The driving shaft of the driver 50 may be connected to a central sun gear in the planetary gear-type gear set 45. When the driving shaft is rotated, a satellite gear and a ring gear in the gear set 45 may rotate together by the rotation of the sun gear.

The first rotation shaft 41 coupled to the bottom surface 33 of the drum 30 may be connected to the ring gear positioned at the outermost portion of the gear set 45. The second rotation shaft 42 coupled to the rotator 100 may be connected to the satellite gear disposed between the sun gear and the ring gear in the gear set 45.

In one example, the gear set 45 may include a first clutch element 46 and a second clutch element 47 that may restrict the rotation of each of the rotation shafts 40 as needed. The gear set 45 may further include a gear housing fixed to the tub 20, and the first clutch element 46 may be disposed in the gear housing to selectively restrict the rotation of the first rotation shaft 41 connected to the ring gear.

The second clutch element 47 may be constructed to mutually restrict or release the rotations of the driving shaft and the ring gear. That is, the rotation of the ring gear or the rotation of the first rotation shaft 41 may be synchronized with or desynchronized with the driving shaft by the second clutch element 47.

In one embodiment of the present disclosure, when the first clutch element 46 and the second clutch element 47 are in the releasing state, the first rotation shaft 41 and the second rotation shaft 42 rotate in the opposite directions based on the rotational relationship of the planetary gear. That is, the drum 30 and the rotator 100 rotate in the opposite directions.

In one example, when the first clutch element 46 is in the restricting state, the rotations of the ring gear and the first rotation shaft 41 are restricted, and the rotation of the second rotation shaft 42 is performed. That is, the drum 30 is in a stationary state and only the rotator 100 rotates. In this connection, the rotation direction of the rotator 100 may be determined based on the rotation direction of the driver 50.

In one example, when the second clutch element 47 is in the restricting state, the rotations of the driving shaft and the first rotation shaft 41 are mutually restricted to each other, and the rotations of the driving shaft, the first rotation shaft 41, and the second rotation shaft 42 may be mutually restricted to each other by the rotational relationship of the planetary gear. That is, the drum 30 and the rotator 100 rotate in the same direction.

When the first clutch element 46 and the second clutch element 47 are in the restricting state at the same time, the driving shaft, the first rotation shaft 41, and the second rotation shaft 42 are all in the stationary state. The controller 70 may implement a necessary driving state by appropriately controlling the driver 50, the first clutch element 46, the second clutch element 47, and the like in the washing process, the rinsing process, and the like.

Figure 3:
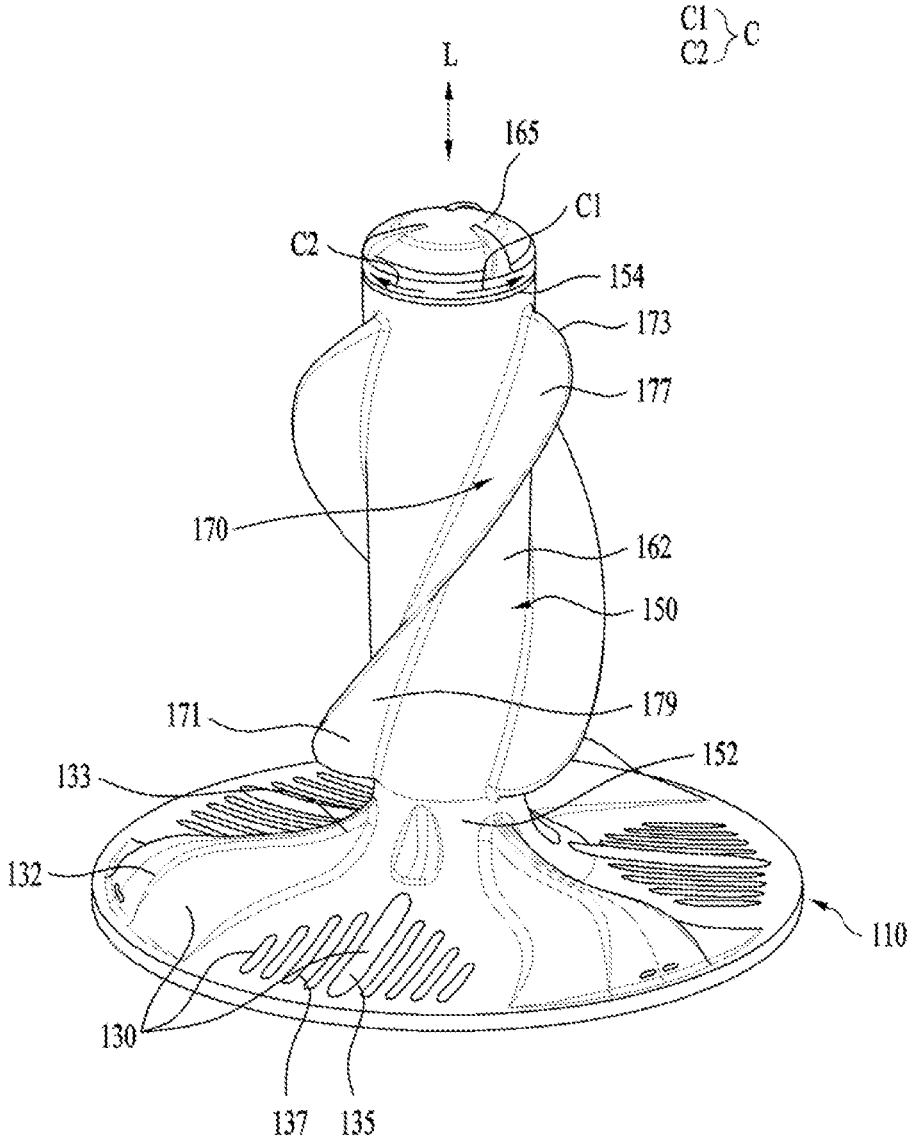
FIG. 3 is a perspective view illustrating a rotator of a laundry treating apparatus according to an embodiment of the present disclosure.

In one example, FIG. 3 is a perspective view of the rotator 100 according to an embodiment of the present disclosure.

In one embodiment of the present disclosure, the rotator 100 may include a bottom portion 110, a pillar 150, and a blade 170.

The bottom portion 110 may be located on the bottom surface 33 of the drum 30. The bottom portion 110 may be positioned parallel to the bottom surface 33 of the drum 30 to be rotatable on the bottom surface 33. The second rotation shaft 42 described above may be coupled to the bottom portion 110.

That is, the first rotation shaft 41 may be coupled to the drum 30, and the second rotation shaft 42 constructed as the solid shaft inside the hollow first rotation shaft 41 may penetrate the bottom surface 33 of the drum 30 and be coupled to the bottom portion 110 of the rotator 100.

The rotator 100 coupled to the second rotation shaft 42 may rotate independently with respect to the drum 30. That is, the rotator 100 may be rotated in the direction the same as or opposite to that of the drum 30, and such rotation direction may be selected by the controller 70 or the like when necessary.

The first rotation shaft 41 may be coupled to a center of the bottom surface 33 of the drum 30. FIG. 1 shows that the top surface of the drum 30 is opened to define the open surface 31 according to an embodiment of the present disclosure, and the bottom surface thereof corresponds to the bottom surface 33.

That is, the laundry treating apparatus 1 shown in FIG. 1 corresponds to a top loader. The drum 30 may have a side surface, that is, an outer circumferential surface, that connects the top surface with the bottom surface, and a cross-section of the drum 30 may have a circular shape for balancing the rotation. That is, the drum 30 may have a cylindrical shape.

The second rotation shaft 42 may be coupled to a center of the bottom portion 110 of the rotator 100. The second rotation shaft 42 may be coupled to one surface facing the drum 30, that is, a bottom surface of the bottom portion 110, or the second rotation shaft 42 may pass through a center of the drum 30 to be coupled to the bottom portion 110.

The bottom portion 110 may have a circular cross-section in consideration of balancing of the rotation. The bottom portion 110 may be rotated about the second rotation shaft 42 coupled to the center thereof, and the center of the bottom portion 110 may coincide with the center of the drum 30.

The bottom portion 110 may basically have a disk shape, and a specific shape thereof may be determined in consideration of a connection relationship between a protrusion 130, the pillar 150, and the like as will be described later.

The bottom portion 110 may cover at least a portion of the drum 30. The bottom portion 110 may be constructed such that the bottom surface thereof and the drum 30 are spaced apart from each other to facilitate the rotation. However, a spaced distance between the bottom portion 110 and the bottom surface 33 of the drum 30 may be varied as needed.

In one example, as shown in FIG. 3, the pillar 150 may have a shape protruding from the bottom portion 110 toward the open surface 31. The pillar 150 may be integrally formed with the bottom portion 110 or manufactured separately and coupled to the bottom portion 110.

The pillar 150 may be rotated together with the bottom portion 110. The pillar 150 may extend from the center of the bottom portion 110 toward the open surface 31. FIG. 1 shows the pillar 150 protruding upwardly from the bottom portion 110 according to an embodiment of the present disclosure. The pillar 150 may have a circular cross-section, and a protruding height L1 from the bottom portion 110 may vary.

The pillar 150 may have a curved side surface forming an outer circumferential surface 162, the rotator 100 may include the blade 170, and the blade 170 may be disposed on the outer circumferential surface 162 of the pillar 150.

The blade 170 may be constructed to protrude from the pillar 150, and may extend along the pillar 150 to form the water flow inside the drum 30 when the pillar 150 rotates.

A plurality of blades 170 may be disposed and spaced apart from each other along a circumferential direction C of the pillar 150, and may extend from the bottom portion 110 to the open surface 31 along a direction inclined with respect to a longitudinal direction L of the pillar 150.

Specifically, as shown in FIG. 3, the blade 170 may extend approximately along the longitudinal direction L of the pillar 150. The plurality of blades 170 may be disposed, and the number of blades may vary as needed. FIG. 3 shows a state in which three blades 170 are disposed on the outer circumferential surface 162 of the pillar 150 according to an embodiment of the present disclosure.

The blades 170 may be uniformly disposed along the circumferential direction C of the pillar 150. That is, spaced distances between the blades 170 may be the same. When viewed from the open surface 31 of the drum 30, the blades 170 may be spaced apart from each other at an angle of 120 degrees with respect to a center O of the pillar 150.

The blade 170 may extend along a direction inclined with respect to the longitudinal direction L or the circumferential direction C of the pillar 150. The blade 170 may extend obliquely from the bottom portion 110 to the open surface 31 on the outer circumferential surface 162 of the pillar 150. An extended length L3 of the blade 170 may be varied as needed.

As the blade 170 extends obliquely, when the rotator 100 is rotated, an ascending or descending water flow may be formed in the water inside the drum 30 by the blade 170 of the pillar 150.

For example, when the blade 170 extends from the bottom portion 110 toward the open surface 31 while being inclined with respect to one direction C1 among the circumferential directions C of the pillar 150, the descending water flow may be formed by the inclined shape of the blade 170 when the rotator 100 rotates in said one direction C1, and the ascending water flow may be formed by the blade 170 when the rotator 100 is rotated in the other direction C2.

In one embodiment of the present disclosure, said one direction C1 and the other direction C2 of the circumferential direction C of the pillar 150 may correspond to directions opposite to each other with respect to the outer circumferential surface 162 of the pillar 150, and may be a direction perpendicular to the longitudinal direction L of the pillar 150.

Said one direction C1 and the other direction C2 of the circumferential direction C of the pillar 150 may correspond to the rotation direction of the rotator 100. Because the rotation direction of the rotator 100 and the circumferential direction C of the pillar 150 are parallel to each other, the rotator 100 may be rotated in said one direction C1 or rotated in the other direction C2.

In one embodiment of the present disclosure, as the plurality of blades 170 are disposed and spaced apart from each other, the water flow may be uniformly formed by the pillar. When the rotator 100 is rotated by the inclined extension form of the blade 170, not a simple rotational water flow, but the ascending water flow in which water at a lower portion of the drum 30 flows upward or the descending water flow in which water at an upper portion of the drum 30 flows downward may occur.

One embodiment of the present disclosure may form a three-dimensional water flow through the rotator 100, and thus greatly improve a washing efficiency for the laundry in the washing process. In addition, various washing schemes may be implemented by appropriately utilizing the ascending water flow and the descending water flow.

The blade 170 according to an embodiment of the present disclosure may have a screw shape. That is, the plurality of blades 170 may be disposed and be spaced apart from each other along the circumferential direction C of the pillar 150, and may extend in the form of the screw from one end 171 facing the bottom portion 110 to the other end 173 facing the open surface 31.

In other words, in one embodiment of the present disclosure, the plurality of blades 170 may extend while being wound on the outer circumferential surface 162 from said one end 152 facing the bottom portion 110 to the other end 154 facing the open surface 31.

In one example, when referring to FIG. 3, in one embodiment of the present disclosure, the blade 170 may be inclined in said one direction C1 among the circumferential directions C of the pillar 150 with respect to the longitudinal direction L of the pillar 150, and may extend from said one end 171 to the other end 173.

That is, the blade 170 may be constructed to be inclined in only said one direction C1 and not to be inclined in the other direction C2. When the inclination direction of the blade 170 is changed to the other direction C2 during the extension, during the rotation of the rotator 100, a portion of the blade 170 may generate the ascending water flow and the remaining portion may generate the descending water flow.

In this case, the ascending water flow and the descending water flow may occur simultaneously in the rotation of the rotator 100 in said one direction C1, so that it may be difficult to maximize the effect of either ascending or descending of the water.

Accordingly, in one embodiment of the present disclosure, the blade 170 extends obliquely with respect to the longitudinal direction L of the pillar 150, and extends obliquely to said one direction C1 among the circumferential directions C of the pillar 150, so that water flow characteristics for the rotation of the rotator 100 in said one direction Cl and the other direction C2 may be maximized. Said one direction C1 may be one of a clockwise direction and a counterclockwise direction, and the other direction C2 may be the other one.

In one example, in one embodiment of the present disclosure as shown in FIG. 3, the blade 170 may continuously extend from said one end 171 to the other end 173. That is, the blade 170 may be continuously extended without being cut between said one end 171 and the other end 173.

In addition, the blade 170 may extend from said one end 171 to the other end 173 to be continuously inclined with respect to the longitudinal direction L of the pillar 150. That is, the blade 170 may be formed in an inclined shape as a whole without a portion parallel to the longitudinal direction L of the pillar 150.

When at least a portion of the blade 170 is parallel to the longitudinal direction L or the circumferential direction C of the pillar 150, it may be disadvantageous to forming the ascending water flow or the descending water flow resulted from the rotation of the pillar 150. Accordingly, in one embodiment of the present disclosure, the blade 170 is inclined with respect to the longitudinal direction L of the pillar 150 over an entire length.

Figure 4:
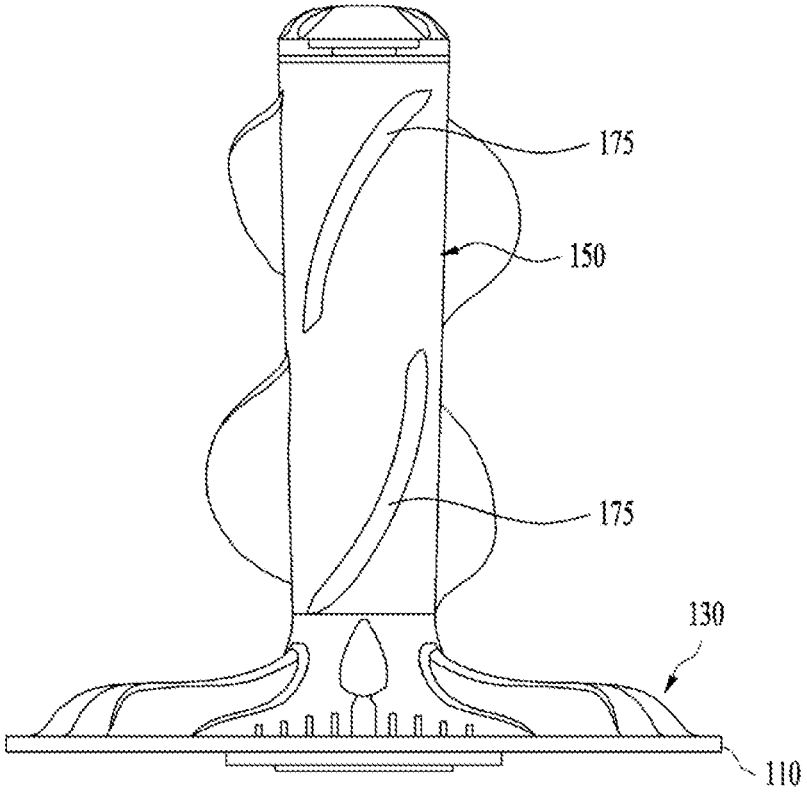
FIG. 4 is a view showing a blade composed of a plurality of divided bodies in a laundry treating apparatus according to another embodiment of the present disclosure.

In one example, another embodiment of the present disclosure is shown in FIG. 4. Referring to FIG. 4, in another embodiment of the present disclosure, the blade 170 may be composed of a plurality of divided bodies 175 separated from each other between said one end 171 and the other end 173.

In another embodiment of the present disclosure, a resistance of water acting on the blade 170 during the rotation of the rotator 100 may be reduced. Accordingly, a load of the driver 50 with respect to the rotation of the rotator 100 may be reduced.

FIG. 4 shows a state in which one blade 170 is composed of two divided bodies 175 according to another embodiment of the present disclosure. However, in FIG. 4, the two divided bodies 175 positioned in a line in a vertical direction do not constitute one blade 170 together. In FIG. 4, a divided body 175 located above corresponds to an upper portion of one blade 170, and a divided body 175 located below corresponds to a lower portion of a blade 170 adjacent to said one blade 170.

In the present disclosure, the blade 170 may be integrally formed or composed of the plurality of divided bodies 175 in consideration of a load of the driver 50, a washing efficiency, and the like that are typically expected in the laundry treating apparatus 1.

Figure 5:
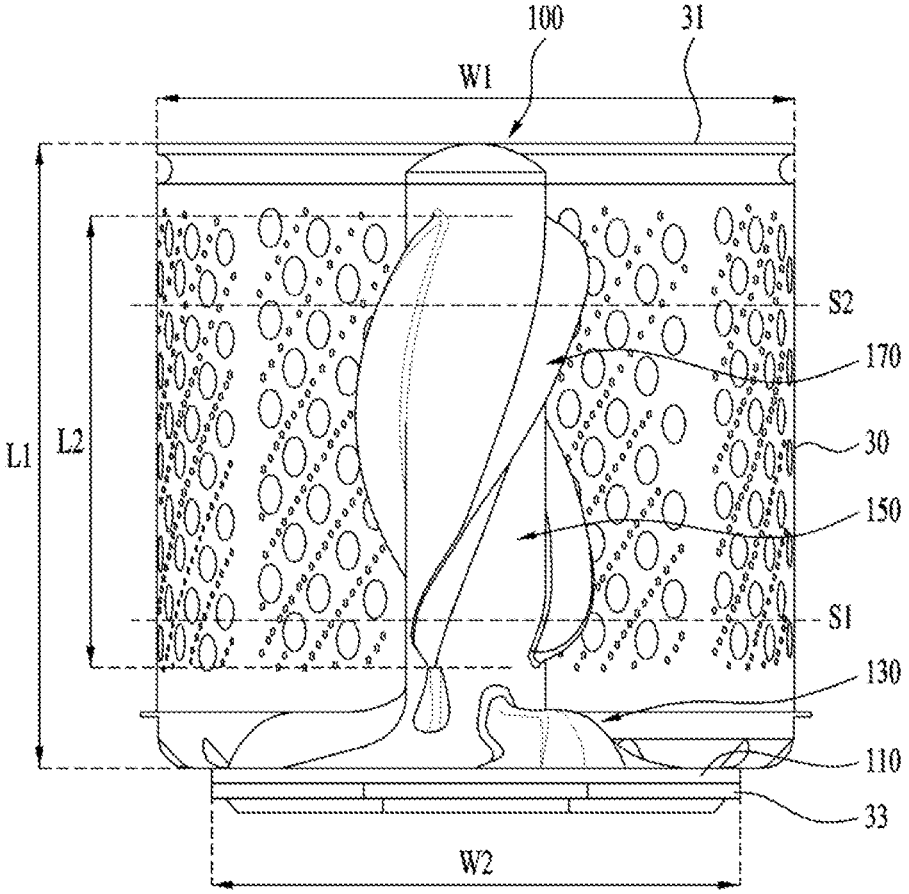
FIG. 5 is a view showing a drum and a rotator in a laundry treating apparatus according to an embodiment of the present disclosure.

In one example, FIG. 5 shows the rotator 100 disposed inside the drum 30 according to an embodiment of the present disclosure.

A length L1 of the pillar 150 may be related to a washing performance and the load of the driver 50. For example, when the length L1 of the pillar 150 is increased, the washing performance may be improved, but an excessive load may be applied to the driver 50. When the length L1 of the pillar 150 is reduced, the load on the driver 50 may be reduced, but the washing performance may also be reduced.

Considering the above relationship, one embodiment of the present disclosure may determine a ratio between the length L1 of the pillar 150 and a diameter W2 of the bottom portion 110. When the length L1 of the pillar 150 is too small, and when an amount of water supplied is large because of a large amount of laundry, because an area in which the water flow is formed by the pillar 150 and the blade 170 is reduced, the washing performance may be deteriorated.

When the length L1 of the pillar 150 is too large, in the washing process, because a surplus length of the pillar 150 that is a length of a portion does not come into contact with the laundry and the water becomes excessive, it may lead to material loss and lead to an unnecessary load increase of the driver 50.

In addition, the bottom portion 110 contributes to the formation of the water flow as a protrusion 130 or the like is formed thereon as will be described below. Therefore, the relationship between lengths of the bottom portion 110 and the pillar 150 determines an effect of the water flow by the bottom portion 110 and an effect of the water flow by the pillar 150.

With respect to various diameters W2 of the bottom portion 110 and lengths L1 of the pillar 150, ascending and descending of the laundry with the water may take place effectively when the length L1 of the pillar 150 is 0.8 times the diameter W2 of the bottom portion 110, and the load of the driver 50 with respect to the rotation of the rotator 100 may be properly maintained when the length L1 of the pillar 150 is equal to or less than 1.2 times the diameter W2 of the bottom portion 110.

The diameter W2 of the bottom portion 110 may be variously determined in consideration of a diameter of the pillar 150, sizes of the tub 20 and the drum 30 of the laundry treating apparatus 1, a capacity of the laundry allowed in the laundry treating apparatus 1, an amount of water supplied resulted therefrom, and the like.

The length L1 of the pillar 150 may be variously determined in consideration of a diameter W1 of the drum 30 as well as a height of the drum 30, a diameter of the pillar 150, an inclination angle A of the blade 170, and the like.

One embodiment of the present disclosure determines an allowable ratio between the length L1 of the pillar 150 and the diameter W2 of the bottom portion 110. Accordingly, the rotator 100 in which the load of the driver 50 is within an allowable range while the formation of the water flow by the pillar 150 is effectively achieved may be implemented.

In one example, in one embodiment of the present disclosure, the diameter W2 of the bottom portion 110 may be equal to or greater than 0.7 times and equal to less than 0.9 times the diameter W1 of the drum 30. However, the present disclosure is not necessarily limited thereto.

Because the bottom portion 110 is positioned on the bottom surface 33 of the drum 30 and rotated, the diameter W2 of the bottom portion 110 with respect to the diameter W1 of the drum 30 needs to be considered. When the diameter W2 of the bottom portion 110 is too small, the effect of the water flow by the rotation of the bottom portion 110 may be too small. When the diameter W2 of the bottom portion 110 is too large, it is easy to cause jamming of the laundry and is disadvantageous in the rotation by the load of the driver 50 and the like.

Considering the above relationship, in one embodiment of the present disclosure, the diameter W2 of the bottom portion 110 is equal to or greater than 0.7 times the diameter W1 of the drum 30, which allows the effect of the water flow by the rotation of the bottom portion 110 with respect to an entirety of the drum 30 to be effective. In addition, the diameter W2 of the bottom portion 110 is equal to or less than 0.9 times the diameter W1 of the drum 30, which prevents the jamming of the laundry and minimizes the load of the rotation.

The diameter W1 of the drum 30 may be variously determined in consideration of the capacity of the laundry allowed in the laundry treating apparatus 1, the amount of water supplied, and a relationship with the tub 20.

In one example, in one embodiment of the present disclosure, the blade 170 may have a height L2 from said one end 171 to the other end 173 in the longitudinal direction L of the pillar 150 equal to or greater than 0.5 times the total height L1 of the pillar 150.

Figure 6:
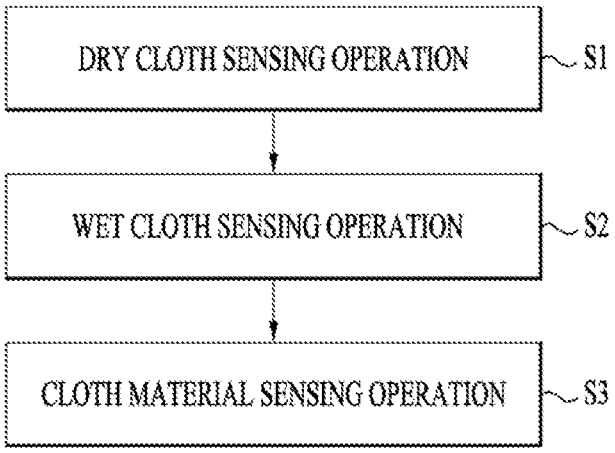
FIG. 6 is a view showing a method for controlling a laundry treating apparatus according to an embodiment.

A vertical level L4 of said one end 171 and a vertical level of the other end 173 of the blade 170 may be defined as vertical distances from a top surface of the bottom portion 110 as shown in FIGS. 5 and 6. The height L2 from said one end 171 to the other end 173 of the blade 170 may be defined as the height of the blade 170.

The height L2 of the blade 170 may be determined in consideration of a relationship between an ascending amount and a descending amount of the water flow by the blade 170 and the load of the driver 50.

For example, as the height L2 of the blade 170 becomes smaller, the area in which the blade 170 is formed may be reduced, and the ascending amount and the descending amount of the water flow may be reduced.

In addition, as the height L2 of the blade 170 becomes greater, a water flow forming force may become stronger, but the load of the driver 50 may be increased. In addition, the height L2 of the blade 170 may be related to the inclination angle A of the blade 170, the diameter of the pillar 150, and the like.

In one embodiment of the present disclosure, the height L2 of the blade 170 may be equal to or greater than 0.5 times the length L1 of the pillar 150. Accordingly, in one embodiment of the present disclosure, the blade 170 may form an ascending water flow and a descending water flow effective inside the drum 30 effective when the pillar 150 rotates. When the height L2 of the blade 170 is less than 0.5 times the length L1 of the pillar 150, it may be difficult to effectively form the water flow by the blade 170.

The height L2 of the blade 170 may be variously determined based on the size of the drum 30, the diameter W2 of the bottom portion 110, the height L1 of the pillar 150, the height of the protrusion 130, the position of the cap 165, and the like.

In one example, in one embodiment of the present disclosure, the blade 170 may have a length L3 extending from said one end 171 to the other end 173 along an extension direction equal to or greater than 1.4 times and equal to or less than 1.8 times the height L2 from said one end 171 to the other end 173 with respect to the longitudinal direction L of the pillar 150. However, this means an optimal design value, and the present disclosure is not necessarily limited thereto.

The length L3 extending from said one end 171 to the other end 173 along the extension direction of the blade 170 may be defined as an extension length of the blade 170, and the height L2 from said one end 171 to the other end 173 of the blade 170 may be defined as a height of the blade 170.

For example, when the number of turns that the blade 170 is wound on the pillar 150 at the same height L2 of the blade 170 is increased, the extension length L3 of the blade 170 is increased.

When the extension length L3 of the blade 170 with respect to the height L2 of the blade 170 becomes larger, a contact area between the blade 170 and the water may increase and the inclination angle A of the blade 170 may be increased. Thus, an influence of the water flow formation on the water may be increased, but the load of the driver 50 may also be increased.

On the other hand, when the extended length L3 of the blade 170 is excessively reduced, the load of the driver 50 may be reduced, but a water flow forming ability may be excessively reduced, thereby reducing the washing efficiency.

In one embodiment of the present disclosure, the extension length L3 of the blade 170 may be equal to or greater than 1.4 times the height L2 of the blade 170 to secure the inclination angle A of the blade 170 for effectively forming the water flow and to effectively secure the contact area between the blade 170 and the water.

In addition, in one embodiment of the present disclosure, the extension length L3 of the blade 170 may be equal to or less than 1.8 times the height L2 of the blade 170, which may be advantageous for formation of a rotational water flow by the blade 170 while the load of the driver 50 does not deviate from an allowable range.

The extension length L3 of the blade 170 may be variously determined based on the height L2 of the blade 170, the diameter of the pillar 150, the inclination angle A of the blade 170, a load amount of the driver 50, a water flow formation level, and the like.

In one example, one embodiment of the present disclosure may include the water supply 60 and the controller 70 as described above. The water supply 60 may be constructed to supply the water into the tub 20, and the controller 70 may control the water supply 60 in the washing process to adjust the amount of water supplied.

The controller 70 may control the water supply 60 such that the amount of water supplied preset based on an amount of laundry selected by the user through the manipulation unit in the washing process is supplied into the tub 20.

For example, when the user selects a minimum amount as the amount of laundry or when the amount of laundry is identified to be the minimum amount through a sensor or the like, a minimum amount of water supplied corresponding to the minimum amount of laundry may be preset in the controller 70, and the controller 70 may control the water supply 60 such that the minimum amount of water supplied is supplied into the tub 20.

In addition, when the amount of laundry is identified as a maximum amount by the user, the sensor, or the like, a maximum amount of water supplied corresponding to the maximum amount of laundry may be preset in the controller 70, and the controller 70 may control the water supply 60 such that the maximum amount of water supplied is supplied into the tub 20.

There may be various minimum criteria for the amount of laundry. For example, in a standard washing capacity test in the United States, an amount of laundry of 3 kg or an amount of laundry of 8 lb is presented as a small amount criteria. In one embodiment of the present disclosure, the minimum amount of water supplied may be an amount of water supplied preset for the laundry amount corresponding to 8 lb. In addition, there may be various maximum criterion for the amount of laundry.

In one embodiment of the present disclosure, a water surface S1 corresponding to the minimum amount of water supplied and a water surface S2 corresponding to the maximum amount of water supplied are shown in FIG. 5. Referring to FIG. 5, in one embodiment of the present disclosure, the controller 70 may control the water supply 60 such that the amount of water supplied is equal to or greater than the preset minimum amount of water supplied in the washing process, and the blade 170 may be constructed such that the vertical level L4 of said one end 171 with respect to the bottom portion 110 is equal to or lower than a vertical level of the water surface S1 corresponding to the minimum amount of water supplied.

When the blade 170 is not submerged in the water, even when the rotator 100 rotates, the ascending water flow and the descending water flow by the blade 170 are not formed, which is disadvantageous. Therefore, in one embodiment of the present disclosure, in the washing process, at least the minimum amount of water supplied may be supplied into the tub 20, and said one end 171 of the blade 170 may be positioned at a vertical level equal to or lower than the vertical level of the water surface S1 corresponding to the preset minimum amount of water supplied such that the blade 171 may be always positioned at a vertical level equal to or lower than a vertical level of a water surface and submerged in the water despite a change in the amount of water supplied.

The minimum amount of water supplied may be the amount of water supplied for the amount of laundry of 8 lb, which is a criteria of a small load test in the authorized laundry test in the United States, as described above.

In one example, in one embodiment of the present disclosure, a height L4 of said one end of the blade 170 may be equal to or less than 0.25 times the diameter W1 of the drum 30. This means an optimal design value and the present disclosure is not necessarily limited thereto.

One embodiment of the present disclosure allows said one end 171 of the blade 170 to be always submerged in the water in the washing process or the rinsing process, so that the water flow formation effect by the rotation of the rotator 100 may occur effectively. To this end, the height L4 of said one end 171 of the blade 170 may be designed to be 0.25 times the diameter W1 of the drum 30.

The vertical level L4 of said one end 171 of the blade 170 may be specifically determined based on the minimum amount of water supplied and the diameter W1 of the drum 30. For example, the larger the minimum amount of water supplied, the higher the vertical level L4 of said one end 171 of the blade 170 may be determined. In addition, the larger the diameter W1 of the drum, the lower the vertical level L4 of said one end 171 of the blade 170.

In one embodiment of the present disclosure, the minimum amount of water supplied may be the amount of water supplied for the amount of laundry of 8 lb as described above. Considering the diameter W1 of the drum 30 that is usually determined therefor, the height L4 of said one end 171 of the blade 170 may be equal to or less than 0.25 times the diameter W1 of the drum 30, and the vertical level L4 may be lower than the vertical level of the water surface S1.

When the height L4 of said one end 171 of the blade 170 exceeds 0.25 times the diameter W1 of the drum 30, the diameter W1 of the drum (30) must be smaller than necessary in order for the vertical level L4 of said one end 171 of the blade 170 to be lower than the vertical level of the water surface S1 of the minimum amount of water supplied. In this case, an allowable amount of laundry in the laundry treating apparatus 1 may be excessively reduced, which may be disadvantageous.

When the pillar 150 protrudes upward from the bottom portion 110 as shown in FIG. 5, the vertical level L4 of said one end 171 of the blade 170 may correspond to a distance from the bottom portion 110 in a vertical upward direction.

In one embodiment of the present disclosure, as the height L4 of said one end 171 of the blade 170 is equal to or less than 0.25 times the diameter W1 of the drum 30, even at the minimum amount of water supplied, said one end 171 of the blade 170 is able to be in contact with the water and at the same time, the diameter W1 of the drum 30 is able to be sufficiently secured, which may be advantageous for the washing performance.

In one example, in an embodiment of the present disclosure, as for the blade 170, said one end 171 may be located below a water surface of the water stored in the tub 20 and the other end 173 may be located above the water surface in the washing process.

In FIG. 5, the vertical level of the water surface S1 at the minimum amount of water supplied and the vertical level of the water surface S2 at the maximum amount of water supplied, according to an embodiment of the present disclosure are indicated. FIG. 5 shows that said one end 171 of the blade 170 is located at a vertical level closer to the bottom portion 110 than the vertical level of the water surface S1 based on the minimum amount of water supplied, and the other end 173 of the blade 170 is located at a vertical level further from the bottom portion 110 than the vertical level of the water surface S2 based on the maximum amount of water supplied.

In one embodiment of the present disclosure, the other end 173 of the blade 170 is disposed to be spaced apart from the water surface of the water stored in the tub 20 toward the open surface 31 at all times, so that the water flow by the blade 170 may always be formed up to an upper portion of the water even when the amount of water stored in the tub 20 is changed in the washing process.

The position of the other end 173 of the blade 170 may be determined in consideration of various factors such as the diameter W1 of the drum 30, the maximum amount of water supplied, the length L1 of the pillar 150, and the like.

In one example, in the laundry treating apparatus 1 according to one embodiment of the present disclosure, the controller 70 may control the water supply 60 such that the amount of water supplied is equal to or less than the preset maximum amount of water supplied in the washing process. In addition, the blade 170 may be constructed such that the vertical level of the other end 173 with respect to the bottom portion 110 may be equal to or higher than the vertical level of the water surface S2 corresponding to the maximum amount of water supplied.

The amount of water supplied to the tub 20 may vary based on the amount of laundry or the result of manipulation of the manipulation unit by the user. One embodiment of the present disclosure allows the other end 173 of the blade 170 to be located at the vertical level equal to or higher than the vertical level of the water surface S2 even for the maximum amount of water supplied that may be provided to the tub 20 in the washing process, so that the water flow by the blade 170 may be formed up to the upper portion of the water stored in the tub 20 even when the amount of water supplied is changed.

FIG. 6 is a view showing a method for controlling a laundry treating apparatus according to an embodiment.

Referring to FIG. 6, a method for controlling a laundry treating apparatus according to an embodiment may include a dry cloth sensing operation (S1), a wet cloth sensing operation (S2), and a cloth material sensing operation (S3).

The dry cloth sensing operation (S1) is an operation of sensing an amount of washing load put into the drum 30. Specifically, it may be an operation in which the amount of washing load put into the drum 30 is sensed and a washing course corresponding thereto is determined. However, the washing course determined in the dry cloth sensing operation (S1) may be changed through the wet cloth sensing operation (S2) and the cloth material sensing operation (S3), which will be described later.

The dry cloth sensing operation (S1) is an operation of sensing the amount of laundry load accommodated in the drum 30. As the washing load increases, the amount of water supplied may increase and an rpm of the drum 30 may increase.

The wet cloth sensing operation (S2) is an operation of sensing a washing load based on a moisture content of a cloth by supplying the water into the tub.

The cloths accommodated in the drum 30 may have different moisture contents depending on a type or a material. For example, fabric may have a greater water content than polyester cloth, and a towel may have a greater water content than clothes.

Therefore, in the wet cloth sensing operation (S2), it is possible to sense the laundry load based on the moisture content, rather than simply measuring the amount of the laundry load.

Specifically, in the wet cloth sensing operation (S2), wash water may be put into the tub (20). As described above, because the moisture content of the clothes accommodated in the drum 30 is different depending on the type and the material, efficient washing may be difficult only with the amount of washing load.

Therefore, the wet cloth sensing operation (S2) may be performed such that a washing course corresponding to the moisture content of the cloth may be performed. The washing course determined in the wet cloth sensing operation (S2) may vary depending on the cloth material sensed in the cloth material sensing operation (S3), which will be described later.

The cloth material sensing operation (S3) is an operation of sensing the cloth material of the clothes put into the drum.

Specifically, this is an operation of sensing the cloth material of the clothes put into the drum an rpm gap, which is a difference between a target rpm and a following rpm at which the rotator 100 is actually rotated based on the target rpm, and a motor-constrained state in which rotation of a motor is constrained.

Prior to a detailed description, the motor-constrained state and the rpm gap will be described.

The motor-constrained state means a state in which the above-described rotator 100 is not rotated by the washing load. In addition, preferably, it may mean a state in which the drum 30 and the rotator 100 are not rotated.

That is, the motor-constrained state may be a state in which an operation of agitating the clothes and the wash water with each other is not performed as the washing course is performed. When the agitation of the clothes and the wash water is restricted, the efficient washing is not able to be performed. Therefore, it is desirable that the washing process be performed differently from a general process.

The rpm gap may be understood by a following equation.

$$(\text{target rpm})-(\text{following rpm})=(\text{rpm gap})$$

Specifically, the controller 70 may control the rotator 100 to rotate at a specific rpm. In this connection, the specific rpm may be described as the target rpm.

The following rpm may be an rpm at which the rotator 100 is actually rotated when the rotator 100 is controlled to rotate at the target rpm by the controller 70. This is because even when the rotator 100 is controlled to rotate at the target rpm by the controller 70, the rotator 100 may not reach the target rpm depending on a quantity, an amount of cloth, and the type of cloth.

Accordingly, it is possible to sense the cloth material through the difference between the target rpm value and the following rpm value.

Figure 7:
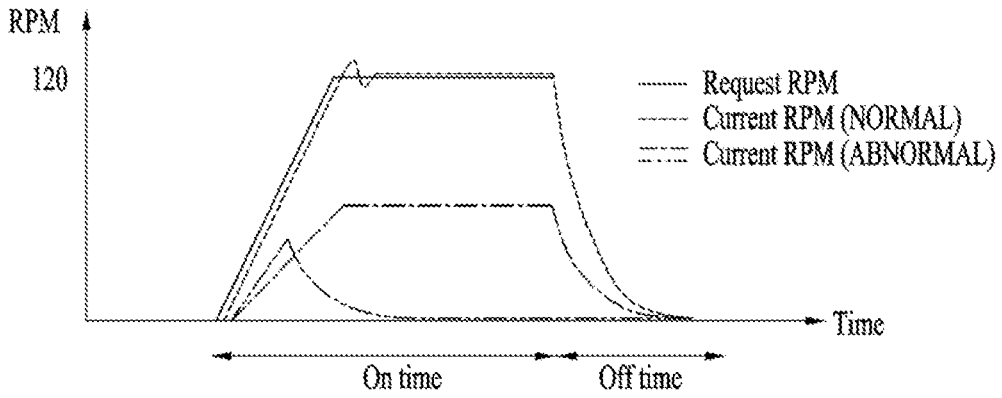
FIG. 7 is a view showing a principle of a cloth material sensing operation.
Figure 8A:
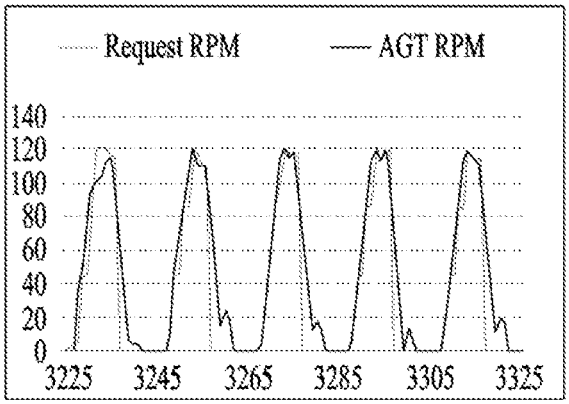
FIGS. 8A and 8B are views showing a target rpm and a following rpm.
Figure 8B:
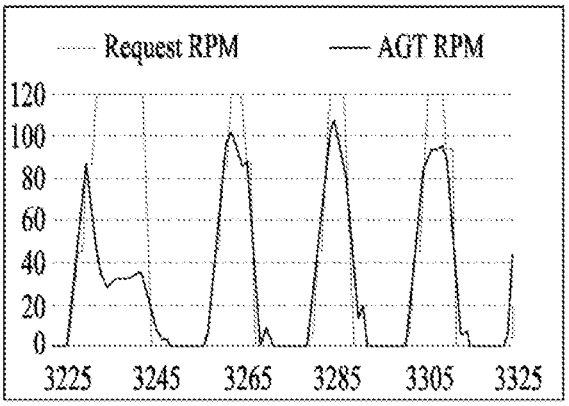

FIG. 7 is a view showing a principle of a cloth material sensing operation, FIGS. 8A and 8B are views showing a target rpm and a following rpm.

Specifically, FIG. 8A is a view showing a case in which the rotator is rotated normally when the target rpm is given, and FIG. 8B is a view illustrating a case in which the rotator is not normally rotated in a specific case when the target rpm is given to the rotator.

In a description with an example with reference to FIG. 7, a solid line is the target rpm, a dotted line is the following rpm during the normal operation, an alternated long and short dash line is a following rpm in a case in which a following ability is low, and an alternate long and two short dashes line is a following rpm in a case in which the motor is constrained.

Referring to FIG. 7, the following rpm corresponding to the target rpm may vary depending on the cloth material. Therefore, the cloth material may be sensed through such rpm difference.

As shown in FIGS. 7 to 8B, the cloth material may be determined based on the motor-constrained state in which the rotation of the motor is constrained, and the rpm gap between the target rpm and the following rpm corresponding to the target rpm.

Figure 9:
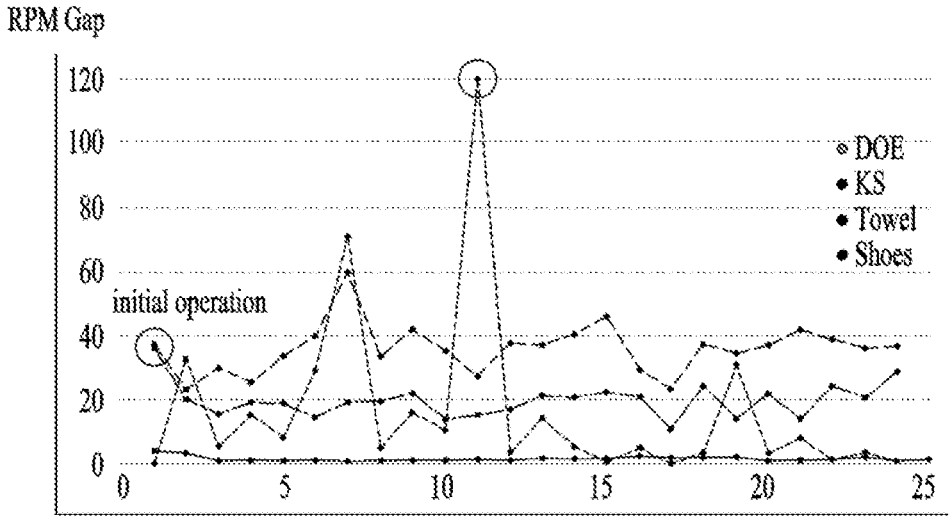
FIG. 9 is a view showing an rpm gap based on a cloth material according to an embodiment.

FIG. 9 is a view showing an rpm gap based on a cloth material according to an embodiment. Embodiments of the present disclosure are not limited to a content shown in FIG. 9. FIG. 9 is shown for a clear understanding of the present disclosure.

Referring to FIG. 9, in a case of the towel or KS (Korean Industrial Standards) standard cloth, the rpm gap may increase during an initial operation of the rotator. In addition, shoes have great rigidity and are heavy and small in volume compared to the clothes. Thus, the rotation of the rotator 100 may be intermittently constrained.

On the other hand, in a case of a load of a DOE (Department of Energy) standard, an rpm following performance is not great. That is, the rpm gap is different depending on the cloth material, or the motor-constrained state in which the rotation of the motor is constrained occurs, so that the controller 70 may control the laundry treating apparatus through the cloth material sensing operation (S3) such that the washing is performed in a scheme suitable for the cloth material.

Figure 10:
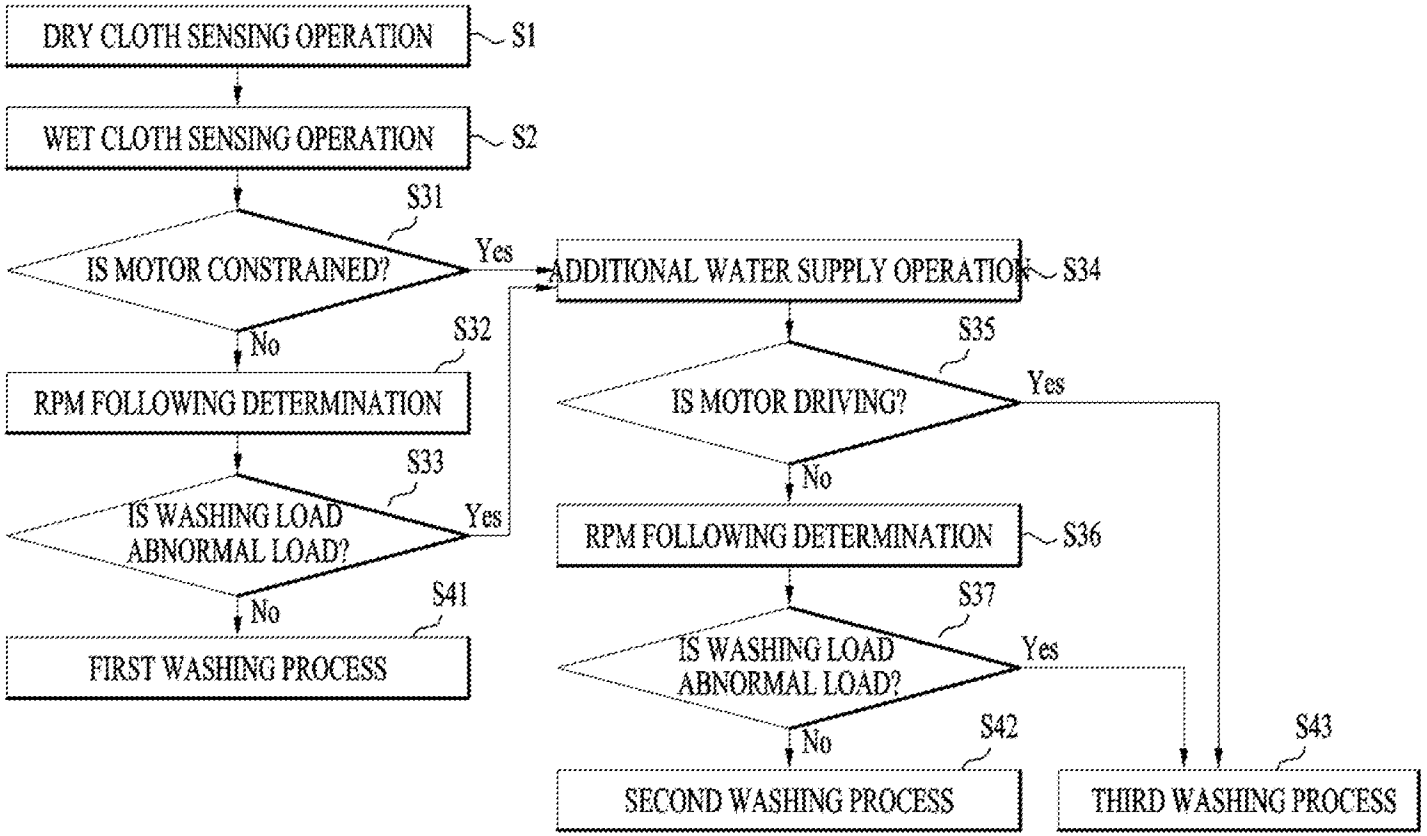
FIG. 10 is a view showing a method for controlling a laundry treating apparatus according to an embodiment.

FIG. 10 is a view showing a method for controlling a laundry treating apparatus according to an embodiment.

Hereinafter, a description of a part the same as that described above will be omitted.

The cloth material sensing operation S3 may include a first cloth material sensing operation and a second cloth material sensing operation.

Specifically, after the wet cloth sensing operation (S2) is performed, the first cloth material sensing operation may be performed. When the motor is constrained in the first cloth material sensing operation or when the washing load is determined to be the abnormal washing load through rpm following determination, additional water supply may be performed and then the second cloth material sensing operation may be performed.

Each operation may proceed in the same manner.

A washing course corresponding to a washing load determined in consideration of the moisture content of the cloth through the wet cloth sensing operation (S2) may be preset. As described above, the washing course may be changed through the cloth material sensing operation (S3).

The cloth material sensing operation (S3) may include a first motor constraint determination operation (S31) of determining whether the motor is in the motor-constrained state in which the rotation of the motor is restricted.

The motor-constrained state in which the rotation of the motor is restricted may be a case in which the rpm gap has the same value as the target rpm. When the rotator 100 is not rotated, the following rpm may be 0 regardless of the target rpm. Accordingly, when the rpm gap has the same value as the target rpm value, it may be determined that the motor is constrained.

When it is determined in the first motor constraint determination operation (S31) that the motor is not in the constrained state (determined that the rotation of the motor is not restricted), a first rpm following determination operation (S32) of determining the rpm gap that is the difference between the target rpm value and the following rpm value may be performed.

The first rpm following determination operation (S32) may be performed including a cycle in which the target rpm is set and the rotator 100 is agitated a preset number of times to measure the following rpm. The cycle may be performed multiple times. Depending on the cloth material, most of the sensing is possible through one cycle. However, the cycle may be performed multiple times in order to increase a sensing performance and secure a reliability of the cloth material sensing.

As an example, most of the cloth materials may be accurately sensed through one cycle, but it may be difficult to secure 100% reliability depending on the cloth material and the cloth amount. However, the cycle may not be performed equal to or more than 3 times. This is because the cloth material may be perfectly distinguished when the cycle is performed no more than 3 times. However, the present disclosure is not limited thereto, and the number of cycles performed may vary based on a performance of the laundry treating apparatus.

In the first rpm following determination operation (S32), it may be determined whether the rpm gap is equal to or less than a preset reference. For example, the preset reference may be about 10 to 20 rpm, preferably 15 rpm.

In the first rpm following determination operation (S32), when the rpm gap is equal to or less than the preset reference, a first washing process S41, which is the washing course determined through the dry cloth sensing operation S1 and the wet cloth sensing operation S2, may be performed.

That is, when the rpm gap is less than the preset reference, the first washing process (S41), which is the washing course corresponding to the washing load, may be performed.

That is, the first washing process (S41) may be a washing course selected in consideration of the amount and the moisture content of cloth accommodated in the drum 30 through the dry cloth sensing operation (S1). In the first washing process (S41), the rotation of the rotator 100 is not restricted, and the rpm of the rotator 100 also normally follows the target rpm. Therefore, the effective washing is possible even when the washing course corresponding to the washing load is performed.

When it is determined in the first rpm following determination operation (S32) that the washing load is the abnormal load (S33), an additional water supply operation (S34) may be performed. Specifically, when it is determined in the first rpm following determination operation (S32) that the rpm gap is equal to or greater than the preset reference or when it is determined in the first motor constraint determination operation (S31) that the motor is in the motor-constrained state in which the rotation of the motor is restricted, the additional water supply operation (S34) may be performed.

The additional water supply operation (S34) may be performed to reduce burden on the rotator 100 resulted from the washing load by increasing a level of the water in the drum 30 or the tub 20. When the water level in the tub 20 increases, the load applied to the rotator 100 may be reduced by buoyancy of the wash water.

After the additional water supply operation (S34) is performed, a second motor constraint determination operation (S35) of determining whether the motor is in the motor-constrained state in which the rotation of the motor is restricted may be performed.

The second motor constraint determination operation (S35) may be performed in the same manner as the first motor constraint determination operation (S31). Therefore, a description of the second motor constraint determination operation (S35) will be omitted.

When the rotation of the motor is not restricted in the second motor constraint determination operation (S35), a second rpm following determination operation (S36) may be performed. The second rpm following determination operation (S36) may be performed in the same manner as the first rpm following determination operation (S32). Therefore, a description of the second rpm following determination operation (S36) will be omitted.

In the second rpm following determination operation (S36), when the rpm gap is equal to or less than the preset reference, a second washing process may be performed. The second washing process may be a washing course corresponding to the water level of the tub 20 or the drum 30 after the additional water supply operation (S34).

That is, the washing is performed at a higher water level in the second washing process (S42) than in the first washing process (S41). Therefore, at least one of the drum 30 and the rotator 100 in the second washing process (S42) may be operated at an rpm greater than an rpm of the drum 30 and the rotator 100 in the first washing process (S41).

When it is determined in the second rpm following determination operation (S36) that the rpm gap is equal to or greater than the preset reference or when it is determined in the second motor constraint determination operation (S35) that the motor is in the motor-constrained state in which the rotation of the motor is restricted, a third washing process (S43) may be performed.

The third washing process (S43) may be a separate washing course from the first washing process (S41) and the second washing process (S42).

The third washing process (S43) is a washing course performed when the rotation of the rotator 100 is restricted or the following rpm is not able to reach the target rpm. Therefore, the third washing process (S43) may be operated at a lower rpm than the first washing process (S41) and the second washing process (S42) to prevent damage to the rotator 100.

Specifically, an rpm of the rotator 100 in the third washing process (S43) may be controlled to be lower than the rpms of the rotator 100 in the first washing process (S41) and the second washing process (S42).

In addition, an rpm of the drum 30 in the third washing process (S43) may also be controlled to be lower than the rpms of the drum 30 in the first washing process (S41) and the second washing process (S42).

In the third washing process (S43), the rotator 100 and the drum 30 may be operated in a motion of rotating in the same direction. This is because when the rotator 100 and the drum 30 rotate in different directions, a torsional torque may be generated larger.

In the case of the normal washing load, it is not a big problem. However, because the third washing process (S43) is the washing course performed when the washing load is determined to be the abnormal washing load, it is preferable that the rotator 100 and the drum 30 are rotated in the same direction.

As an example, the rotator may be rotated at 100 rpm in the first washing process (S41), at 120 rpm in the second washing process (S42), and at an rpm equal to or lower than 100 rpm in the third washing process (S43).

In addition, in the third washing process (S43), the drum (30) may be rotated at a low rpm equal to or lower than 50 rpm. This may be to prevent a case of scattering water in the laundry treating apparatus.

A rotation angle of the rotator 100 may be set to be equal to or lower than 90 degrees. As the rotation angle of the rotator 100 increases, the load applied to the driver 50 or the rotator 100 may increase. A detailed description thereof will be given later.

Although not shown in the drawing, when additional water supply is possible before the third washing process (S43) is performed, the additional water supply may be further performed before the third washing process (S43). As the amount of water increases, the load applied to the rotator 100 decreases, so that the additional water supply may be performed when the additional water supply of the wash water into the tub 20 or the drum 30 is possible.

Figure 11A:
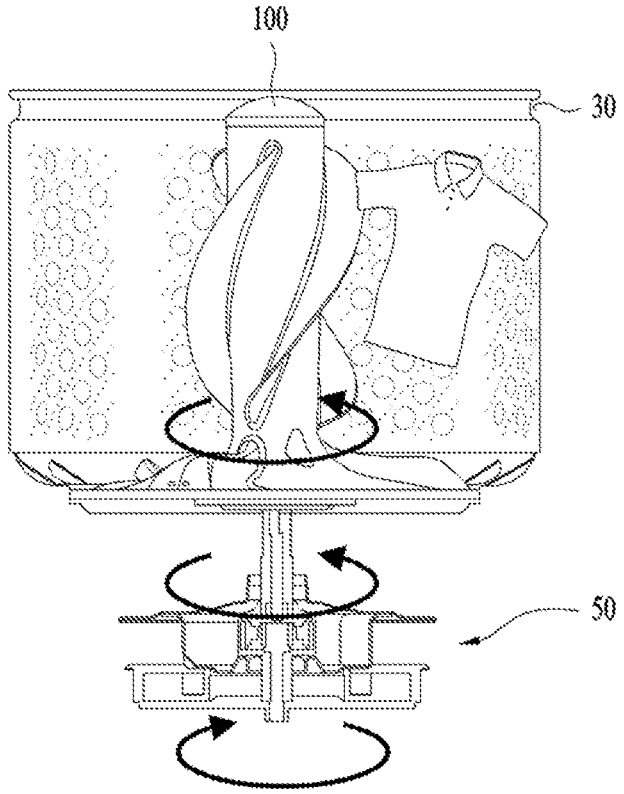
FIGS. 11A and 11B are views of loads applied to a driver and a rotator of a laundry treating apparatus.
Figure 11B:
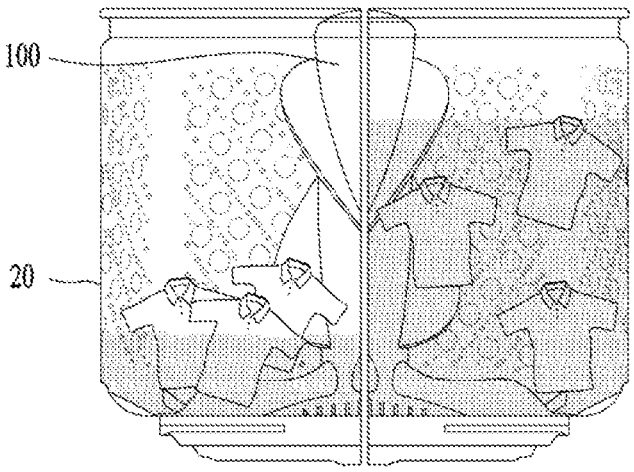

FIGS. 11A and 11B are views of loads applied to a driver and a rotator of a laundry treating apparatus.

FIG. 11A is a view showing the load applied to the rotator, and FIG. 11B is a view showing a water level of the wash water in the drum.

Hereinafter, with reference to FIGS. 11A and 11B, the load applied to the driver 50 or the rotator 100 will be described.

In a case of a conventional top loader impeller (pulsator) washing machine, a vertical level and an area of a washboard is lower and smaller than those of a washboard of the laundry treating apparatus according to an embodiment of the present disclosure, so that washing by the buoyancy is possible. Therefore, because a magnitude of a torque transmitted to a shaft system is not large depending on a type of the load, the washing process may be configured relatively simply.

In addition, because the buoyancy resulted from the wash water put into the drum acts, in a case of a load level (a water level) at which a large amount of water is used, a mechanical force is not transmitted as it is, but is reduced by the buoyancy, so that the rotation rpm and the rotation angle increase as the amount of water increases, which is a linear characteristic.

On the other hand, in the case of the laundry treating apparatus according to an embodiment of the present disclosure, because the mechanical force is transmitted to the cloth as it is because of the rotator located at the center of the drum, so that the torque transmitted to the shaft system is large.

When an amount of load applied to the shaft system is large, the washing performance is deteriorated when the motor is constrained because of the laundry being caught in the blade of the rotator, which is a major cause of damage to the shaft system or the damage to the rotator.

The torque acting on the rotator 100 increases in proportion to a weight of the load, and decreases as a density of the cloth (an amount of load input/the amount of water) decreases when the amount of water input increases.

FIGS. 12A to 15B are views showing factors related to a load applied to a rotator in a third washing process.

Prior to describing FIGS. 12A to 15B, the third washing process will be described in detail.

As described above, the third washing process (S43) is the washing course performed when the rotation of the motor is restricted or the following rpm is equal to or lower than the target rpm and the preset reference, despite the additional water supply operation (S34).

The torque applied to the rotator 100 may be affected by the operation scheme of the drum 30 and the rotator 100 used in the third washing process (S43).

In the third washing process (S43), the rotator 100 and the drum 30 may be operated in the scheme of rotating in the same direction.

More specifically, the rotation of the rotator 100 may include a first rotation forming an ascending water flow and a second rotation forming a descending water flow.

As described above, when the blade 170 of the rotator 100 extends inclined in one direction from the bottom surface toward the open surface, the rotator 100 forms the ascending water flow when being rotating in the other direction. Conversely, when the blade 170 of the rotator 100 extends inclined in the other direction from the bottom surface toward the open surface side, the rotator 100 forms the ascending water flow when being rotated in one direction.

This case may be viewed as the first rotation forming the ascending water flow. Because the second rotation is the opposite of the first rotation, a description thereof will be omitted.

In the third washing process (S43), the rotator 100 may perform the second rotation as much as the first rotation is performed. For example, when the rotator 100 is rotated 90 degrees in the direction forming the ascending water flow, the rotator 100 may be rotated 90 degrees in the direction forming the descending water flow.

The numbers of rotations of the rotator 100 and the drum 30 in the third washing process (S43) may become different. For example, the drum 30 may be operated at an rpm equal to or lower than 50 rpm, and the rotator 100 may be operated at an rpm equal to or lower than 100 rpm. This is because, as the third washing process is a case in which an excessive load is input or a special washing load is input, a large torque may be applied to the rotator 100 when the drum rotates at a high rpm.

A magnitude of the torque acting on the rotator 100 may vary by several factors while the third washing process (S43) is performed.

Specifically, when the target rpm of the rotator, an acceleration slope for reaching the target rpm, the rotation angle of the rotator, and the rotation direction of the rotator change, an idle time during which power supply to the rotator is stopped, and the like may affect the torque applied to the rotator 100.

Figure 12A:
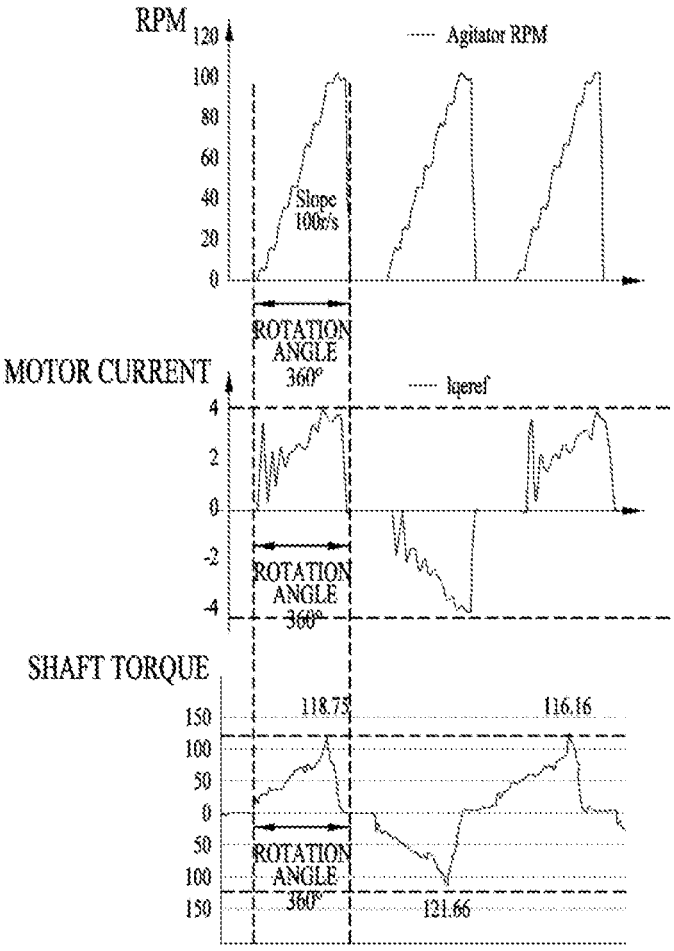
FIGS. 12A to 15B are views showing factors related to a load applied to a rotator in a third washing process.
Figure 12B:
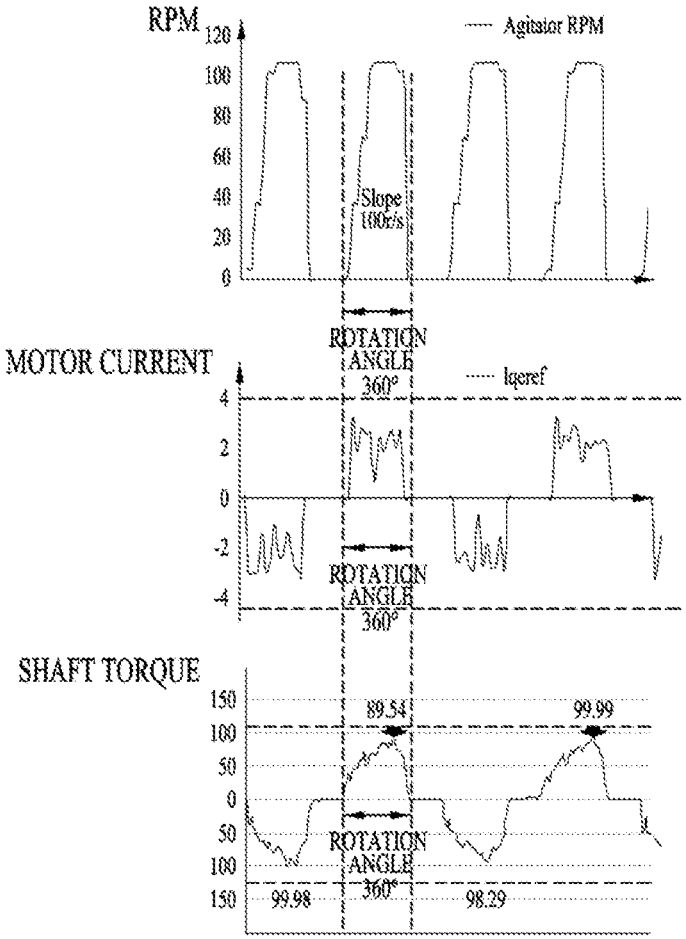

FIGS. 12A and 12B are views showing a difference in the acceleration slope for reaching the target rpm.

FIG. 12A is a view illustrating a case in which the acceleration slope is 100 rpm/sec, and FIG. 12B is a view illustrating a case in which the acceleration slope is 300 rpm/sec.

FIGS. 12A and 12B are only views showing an example, and it is clear that the present disclosure is not limited to the acceleration slopes shown in FIGS. 12A and 12B.

Referring to FIGS. 12A and 12B, it may be seen that the magnitude of the torque acting on the rotator 100 is reduced when the acceleration slope is high in the third washing process (S43).

When the acceleration slope is large, a time it takes to reach the target rpm is shortened, and the driver 50 applies a low current to the rotator 100 in a high-speed region, so that the torque acting on the rotator 100 is reduced.

In the examples shown in FIGS. 12A and 12B, it may be seen that the time it takes to reach the target rpm becomes shorter as an rpm increasing speed for each unit time increases, and accordingly, the current applied to the motor decreases.

It is also shown that a torque acting on the rotator 100 in the embodiment shown in FIG. 12B is smaller than a torque acting on the rotator 100 in the embodiment shown in FIG. 12A. Therefore, it is easy to prevent the damage and a failure of the rotator 100 when the acceleration slope is large, as in the embodiment shown in FIG. 12B.

In addition, because the third washing process (S43) corresponds to the washing course performed when the washing load is detected to be the abnormal load, it may be controlled that an acceleration slope in the third washing process (S43) is greater than acceleration slopes in the first washing process (S41) and the second washing process (S42).

Figure 13A:
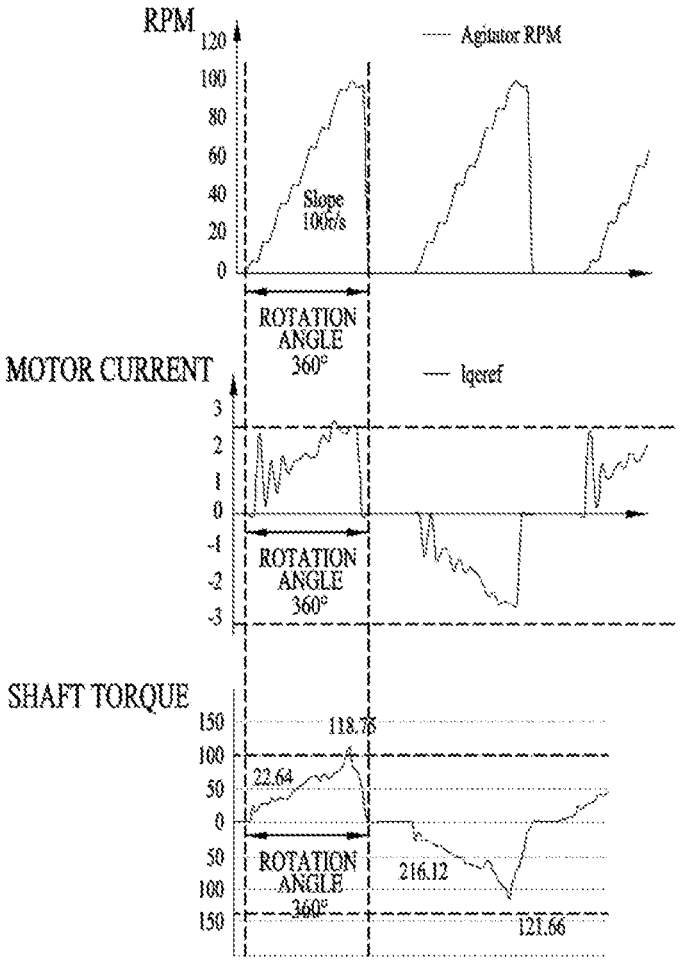
Figure 13B:
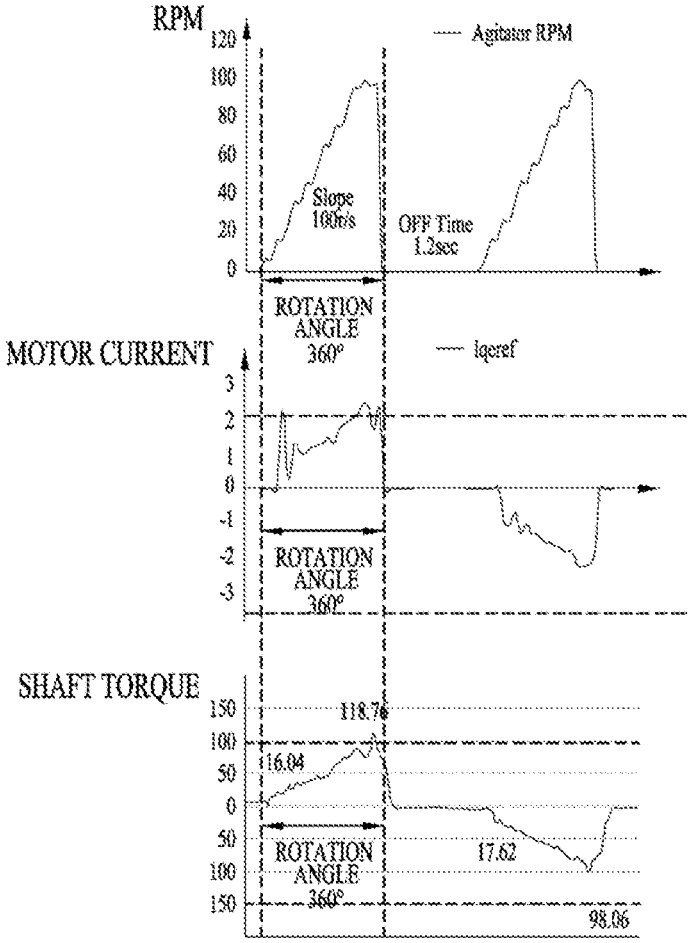

FIGS. 13A and 13B are views illustrating a difference in the idle time during which the power supply to the rotator is stopped when the rotation direction of the rotator is changed. FIGS. 13A and 13B are one example, and the present disclosure does not always have to be operated to have idle times shown in FIGS. 13A and 13B.

FIG. 13A is a view showing a case in which the idle time is 0.3 sec, and FIG. 13B is a view showing a case in which the idle time is 1.2 sec.

Referring to FIGS. 13A and 13B, it may be seen that, when the rotator 100 changes the rotation direction, the longer the idle time during which the power supply to the rotator 100 is stopped, the smaller the torsional torque acting on the rotator 100.

Specifically, when the idle time is long, because the motor of the driver 50 and the rotator 100 may be sufficiently decelerated during the idle time, the torsional torque applied to the rotator 100 may be reduced when reversing the rotation direction of the rotator 100 to the opposite direction.

In addition, the longer the idle time, the less the rotational inertia when the rotation direction of the rotator 100 is reversed, so that the torque acting on the rotator 100 may be reduced.

In addition, because the third washing process (S43) corresponds to the washing course performed when the washing load is detected to be the abnormal load, it may be controlled that an idle time in the third washing process (S43) is longer than idle times in the first washing process (S41) and the second washing process (S42).

Figure 14A:
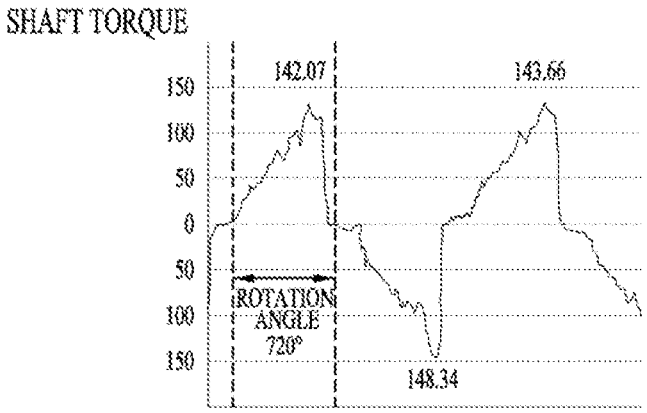
Figure 14B:
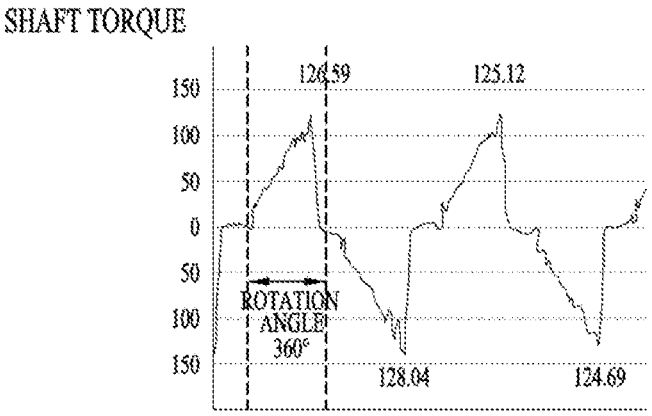

FIGS. 14A and 14B are views showing a difference in the rotation angle of the rotator. FIGS. 14A and 14B are only one example, and the rotator does not always have to be rotated at rotation angles shown in FIGS. 14A and 14B.

FIG. 14A is a view showing that the rotator rotates 720 degrees, and FIG. 14B is a view showing that the rotator rotates 360 degrees.

Referring to FIGS. 14A and 14B, it may be seen that the smaller the rotation angle, the smaller the torque applied to the rotator 100.

Specifically, when the rotation angle of the rotator 100 is large, a time it takes to rotate becomes longer, and the current must be continuously applied, so that the magnitude of the torque acting on the rotator 100 may increase.

In addition, the rotation angle of the rotator 100 may be controlled to be in a rotation angle range from 88 to 92 degrees, preferably to be about 90 degrees. As described above, the larger the rotation angle of the rotator 100, the more the load acts on the rotator 100. However, when the rotation angle of the rotator 100 is too small, the washing load and the wash water are not able to be agitated by the rotator 100, so that the effective washing may become impossible.

For example, when a lot of towels or shoes are input, it is difficult to secure the washing performance unless the rotator 100 agitates the washing load. In addition, when the rotation angle of the rotator 100 is too large, it may cause the damage or the failure of the rotator 100. Therefore, it is preferable that the rotation angle of the rotator 100 is maintained to have an appropriate magnitude.

In addition, because the third washing process (S43) corresponds to the washing course performed when the washing load is detected to be the abnormal load, it may be controlled that a rotation angle of the rotator 100 in the third washing process (S43) is greater than rotation angles of the rotator 100 in the first washing process (S41) and the second washing process (S42).

Figure 15A:
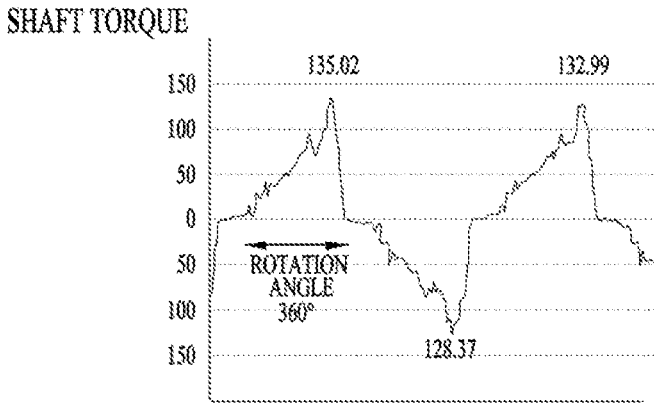
Figure 15B:
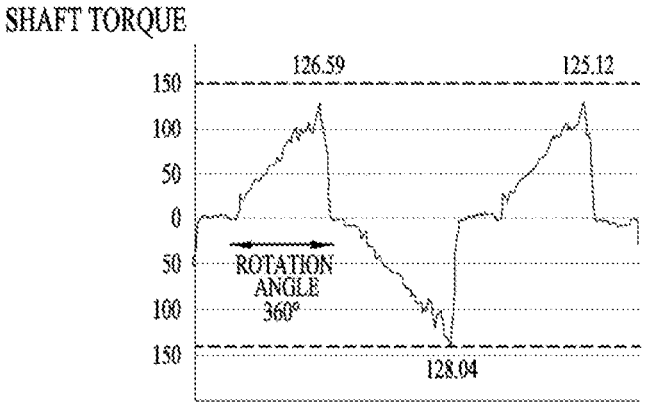

FIGS. 15A and 15B are views showing a magnitude of a torque corresponding to a magnitude of the target rpm of the rotator. FIGS. 15A and 15B are only one example, and the rotator does not always have to be operated at target rpms shown in FIGS. 15A and 15B.

FIG. 15A is a view illustrating a case in which the target rpm is 150 rpm, and FIG. 15B is a view illustrating a case in which the target rpm is 100 rpm.

Referring to FIGS. 15A and 15B, it may be seen that the torque applied to the rotator 100 decreases as the target rpm of the rotator 100 decreases.

Specifically, when the target rpm of the rotator 100 is large, the time it takes to reach the target rpm becomes longer, and the current must be continuously applied until the target rpm is reached, so that the magnitude of the torque acting on the rotator 100 may increase.

In this connection, the rotator 100 may be rotated to have the target rpm equal to or lower than 100 rpm. Preferably, the rotator 100 may be controlled to have an rpm in a range from 80 to 100 rpm.

This may be to prevent the case of scattering water in the laundry treating apparatus.

In addition, because the third washing process (S43) corresponds to the washing course performed when the washing load is detected to be the abnormal load, it may be controlled that a target rpm of the rotator 100 in the third washing process (S43) is greater than target rpms of the rotator 100 in the first washing process (S41) and the second washing process (S42).

Although various embodiments of the present disclosure have been described in detail above, those of ordinary skill in the technical field to which the present disclosure belongs will understand that various modifications are possible with respect to the above-described embodiment without departing from the scope of the present disclosure. Therefore, the scope of rights of the present disclosure should not be limited to the described embodiment and should be defined by the claims described later as well as the claims and equivalents.

What is claimed is:

1. A method for controlling a laundry treating apparatus including a tub, a drum that is rotatably disposed inside the tub and has an open surface configured to receive clothes therethrough and a bottom surface located at an opposite side of the open surface, a rotator rotatably disposed inside the drum, a motor configured to drive the drum and the rotator, and a controller configured to control operation of the motor, the rotator including a bottom portion disposed at the bottom surface, a pillar that protrudes from the bottom portion toward the open surface, and a plurality of blades that are spaced apart from one another along a circumferential direction of the pillar and that extend toward the open surface along a direction inclined with respect to a longitudinal direction of the pillar, the method comprising:

sensing an amount of the clothes in the drum;

supplying water into the tub;

sensing a washing load of the clothes that include a moisture content from the water supplied into the tub;

supplying power to the motor to rotate the rotator at a predetermined target revolution per minute (rpm);

determining an actual rpm of the rotator;

determining a rpm gap that is a difference between the target rpm of the rotator and the actual rpm; and determining a cloth material of the clothes based on the rpm gap and whether the motor is in a motor-constrained state in which rotation of the motor is restricted.

2. The method of claim 1, wherein determining the cloth material comprises:

determining whether the motor is in the motor-constrained state after sensing the washing load of the clothes.

3. The method of claim 2, wherein determining the cloth material comprises:

determining a first rpm gap between the target rpm and the actual rpm of the rotator in a state in which rotation of the motor is not restricted.

4. The method of claim 3, wherein determining the first rpm gap comprises:

performing a cycle including rotating the rotator for a preset number of times based on the target rpm being set; and determining the first rpm gap based on a result of the performance of the cycle.

5. The method of claim 4, wherein determining the first rpm gap comprises performing the cycle for a multiple number of times.

6. The method of claim 3, further comprising:

based on the first rpm gap being less than or equal to a preset reference, performing a first washing process according to the washing load.

7. The method of claim 6, further comprising:

based on the first rpm gap being greater than the preset reference or the motor being in the motor-constrained state, supplying additional water into the tub.

8. The method of claim 7, further comprising:

determining whether the motor is in the motor-constrained state after the additional water is supplied into the tub.

9. The method of claim 8, further comprising:

determining a second rpm gap between the target rpm and the actual rpm of the rotator based on determining that the motor is no longer in the motor-constrained state after the additional water is supplied into the tub.

10. The method of claim 9, further comprising:

performing a cycle including rotating the rotator for a preset number of times after the additional water is supplied into the tub; and determining the second rpm gap based on a result of the performance of the cycle.

11. The method of claim 10, further comprising:

based on the second rpm gap being less than or equal to the preset reference, performing a second washing process according to a water level in the tub after the additional water is supplied into the tub.

12. The method of claim 11, wherein performing the first washing process comprises rotating the rotator at a first rpm, and wherein performing the second washing process comprises rotating the rotator at a second rpm that is greater than the first rpm.

13. The method of claim 11, further comprising:

based on the motor being in the motor-constrained state or the second rpm gap being greater than the preset reference, performing a third washing process that is different from the first washing process and the second washing process.

14. The method of claim 13, wherein performing the third washing process comprises rotating the rotator at an rpm that is less than rpms of the rotator in the first washing process and the second washing process.

15. The method of claim 14, wherein rotating the rotator in the third washing process comprises rotating the rotator by a rotation angle that is less than or equal to 90 degrees with respect to a reference position.

16. The method of claim 13, further comprising:

supplying additional water into the tub before performing the third washing process; and performing the third washing process after the additional water is supplied into the tub.

17. The method of claim 1, further comprising:

determining that the motor is in the motor-constrained state based on the rpm gap being equal to the target rpm.

18. A laundry treating apparatus comprising:

a cabinet;

a tub configured to receive water;

a drum rotatably disposed inside the tub, the drum having an open surface configured to receive clothes therethrough and a bottom surface located at an opposite side of the open surface;

a rotator rotatably disposed inside the drum;

a motor configured to drive the drum and the rotator; and a controller configured to control operation of the motor, wherein the rotator comprises:

a bottom portion disposed at the bottom surface of the drum, a pillar that protrudes from the bottom portion toward the open surface of the drum, and a plurality of blades that are spaced apart from one another along a circumferential direction of the pillar and extend toward the open surface along a direction inclined with respect to a longitudinal direction of the pillar, and wherein the controller is configured to:

supply power to the motor to rotate the rotator at a predetermined target revolution per minute (rpm) in a state in which water is supplied in the tub, determine an actual rpm of the rotator, determine a rpm gap that is a difference between the target rpm of the rotator and the actual rpm, and determine a cloth material of the clothes based on the rpm gap and whether the motor is in a motor-constrained state in which rotation of the motor is restricted.

19. The laundry treating apparatus of claim 18, wherein the controller is configured to:

based on the motor being in the motor-constrained state or the rpm gap being greater than or equal to a preset reference, determine the cloth material after supplying additional water into the tub.

20. The laundry treating apparatus of claim 18, wherein the controller is configured to, based on the rpm gap being equal to the target rpm, determine that the motor is in the motor-constrained state.

* * * * *